US012247374B2

(12) United States Patent
Hamamoto et al.

(10) Patent No.: US 12,247,374 B2
(45) Date of Patent: Mar. 11, 2025

(54) WORKING MACHINE

(71) Applicant: KUBOTA CORPORATION, Osaka (JP)

(72) Inventors: Ryota Hamamoto, Osaka (JP); Kazuki Ueda, Osaka (JP); Daiki Abe, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 337 days.

(21) Appl. No.: 18/075,917

(22) Filed: Dec. 6, 2022

(65) Prior Publication Data

US 2023/0228062 A1 Jul. 20, 2023

(30) Foreign Application Priority Data

Dec. 28, 2021 (JP) ..... 2021-213681

(51) Int. Cl.
*E02F 9/22* (2006.01)
*E02F 9/20* (2006.01)

(52) U.S. Cl.
CPC ..... *E02F 9/2228* (2013.01); *E02F 9/2004* (2013.01); *E02F 9/2246* (2013.01); *E02F 9/2253* (2013.01); *E02F 9/2267* (2013.01); *E02F 9/2285* (2013.01); *E02F 9/2292* (2013.01)

(58) Field of Classification Search
CPC ..... E02F 9/2292; E02F 9/2253; E02F 9/2228; E02F 9/2246
See application file for complete search history.

(56) References Cited

U.S. PATENT DOCUMENTS 7,686,737 B2 * 3/2010 Nishi ..... F16H 61/423 477/68
11,384,511 B2 * 7/2022 Oouchi ..... F16H 61/4078
2021/0404150 A1 * 12/2021 Fukuda ..... F16H 61/47

FOREIGN PATENT DOCUMENTS

JP 2017-115441 A 6/2017

* cited by examiner

*Primary Examiner* — Abiy Teka

(74) *Attorney, Agent, or Firm* — Greenblum & Bernstein, P.L.C.

(57) ABSTRACT

A working machine includes a controller that performs shift shock reduction control when shift-down switching from a second state to a first state, in which a motor speed can be increased up to a first maximum speed lower than a second maximum speed available in the second state, is performed. The controller includes a first processor configured to, based on a drop amount that is a difference between target and actual numbers of revolutions of a prime mover, compute a first reduction amount for reducing an amount of hydraulic fluid supply from a traveling pump to a traveling motor, a second processor configured to compute a second reduction amount based on a degree of straight traveling of a machine body, and a reduction controller configured to, based on the first or second reduction amount, whichever is larger in absolute value, perform the shift shock reduction control.

20 Claims, 12 Drawing Sheets

Fig.8

TB Data table

| Drop amount | First reduction amount |
|---|---|
| ΔD1(ΔD1a) | ΔF2(ΔF2a) |
| ⋮ | ⋮ |
| ΔD1(ΔD1b) | ΔF2(ΔF2b) |
| ⋮ | ⋮ |
| ΔD1(ΔD1c) | ΔF2(ΔF2c) |

WORKING MACHINE

CROSS REFERENCE TO RELATED APPLICATIONS

This application claims the benefit of priority to Japanese Patent Application No. 2021-213681 filed on Dec. 28, 2021. The entire contents of this application are hereby incorporated herein by reference.

BACKGROUND OF THE INVENTION

1. Field of the Invention

The present disclosure relates to a working machine such as, for example, a skid-steer loader, a compact track loader, or a backhoe.

2. Description of the Related Art

A technique for reducing a shift shock caused during shift-down operation of a working machine, as an example of related art, is disclosed in Japanese Unexamined Patent Application Publication No. 2017-115441. A working machine disclosed in this related-art publication includes a prime mover, a hydraulic pump configured to operate by power of the prime mover and deliver a hydraulic fluid, a detector configured to detect a state of the working machine, an index determiner configured to determine an index value based on a state of the working machine detected by the detector, a processor configured to compute a drop amount that is a difference between a target number of revolutions of the prime mover indicated by the index value determined by the index determiner and an actual number of revolutions of the prime mover, and an output reducer configured to reduce an output of the hydraulic pump in a case where the drop amount is not smaller than a predetermined amount.

SUMMARY OF THE INVENTION

In the working machine disclosed in the publication mentioned above, when shift-down operation is performed, the output of the hydraulic pump is reduced according to a drop amount that is a difference between a target number of revolutions of the prime mover and an actual number of revolutions of the prime mover in an attempt to reduce a shift shock caused during the shift-down operation; however, it is sometimes difficult to reduce the shift shock properly. For example, it is difficult to achieve a proper shift shock reduction when the speed stage of the machine is shifted down while it is in a turn traveling state.

The disclosed technique has been devised to address technical issues of related art such as those described above. An object of the disclosed technique is to provide a working machine capable of performing shift shock reduction control at the time of shift-down operation effectively.

Preferred embodiments of the present invention provide the technical solutions as follows.

A working machine according to a preferred embodiment of the invention includes: a prime mover; a traveling pump to operate by power of the prime mover and deliver a hydraulic fluid; a traveling motor to rotate with the hydraulic fluid delivered by the traveling pump; a machine body in which the prime mover, the traveling pump, and the traveling motor are provided; a traveling switching valve operable to switch between a first state allowing a rotation speed of the traveling motor to increase up to a first maximum speed, and a second state allowing the rotation speed of the traveling motor to increase up to a second maximum speed higher than the first maximum speed; a traveling manipulator including an operation valve configured to change hydraulic fluid pressure acting on the traveling pump in response to operation of an operation member; and a controller configured or programmed to perform shift shock reduction control of reducing an amount of hydraulic fluid supply from the traveling pump to the traveling motor when shift-down switching from the second state to the first state is performed, the controller including a first processor configured or programmed to, based on a drop amount that is a difference between a target number of revolutions of the prime mover and an actual number of revolutions of the prime mover, compute a first reduction amount for reducing the amount of hydraulic fluid supply from the traveling pump to the traveling motor in the shift shock reduction control; a second processor configured or programmed to, based on a degree of straight traveling of the machine body, compute a second reduction amount for reducing the amount of hydraulic fluid supply from the traveling pump to the traveling motor in the shift shock reduction control; and a reduction controller configured or programmed to, based on a reduction amount that is either the first reduction amount computed by the first processor or the second reduction amount computed by the second processor, whichever is larger in absolute value, perform the shift shock reduction control.

The first processor may be configured or programmed to, based on the drop amount that is the difference between the target number of revolutions of the prime mover and the actual number of revolutions of the prime mover, compute the first reduction amount that is an amount of reduction in number of revolutions of the prime mover in the shift shock reduction control. The second processor may be configured or programmed to, based on the degree of straight traveling of the machine body, compute the second reduction amount that is an amount of reduction in the number of revolutions of the prime mover in the shift shock reduction control. The reduction controller may be configured or programmed to perform the shift shock reduction control of reducing the amount of hydraulic fluid supply from the traveling pump to the traveling motor by reducing the number of revolutions of the prime mover based on the first reduction amount computed by the first processor or the second reduction amount computed by the second processor, whichever is larger in absolute value.

The reduction controller may be configured or programmed to set, as a reduced value of the number of revolutions of the prime mover in the shift shock reduction control, a value obtained by subtracting the reduction amount from the actual number of revolutions of the prime mover.

In a reduction interval till the actual number of revolutions of the prime mover reaching the reduced value, the reduction controller may be configured or programmed to set a first rate of reduction in the actual number of revolutions of the prime mover to be constant from a starting point of the reduction interval to an ending point of the reduction interval.

In a reduction interval till the actual number of revolutions of the prime mover reaching the reduced value, the reduction controller may be configured or programmed to set a second rate of reduction in the actual number of revolutions of the prime mover in an interval from a starting point of the reduction interval to some midpoint therein to be higher than a third rate of reduction in the actual number of revolutions of the prime mover in an interval from said some midpoint to an ending point of the reduction interval.

The reduction controller may be configured or programmed to vary timing of switching the traveling switching valve from the second state to the first state according to the drop amount.

The working machine may further include: a selector switch configured to issue a shift command for either shift-up switching or shift-down switching; and an accelerator configured to set the target number of revolutions of the prime mover, wherein when the selector switch issues the shift command for the shift-down switching, the reduction controller may be configured or programmed to reduce the actual number of revolutions of the prime mover toward a reduced value set based on the reduction amount, and switch the traveling switching valve to either the first state or the second state in accordance with the shift command.

The reduction controller may be configured or programmed to set the reduction amount to be larger as the drop amount is smaller and set the reduction amount to be smaller as the drop amount is larger.

The working machine may further include: an actuation valve connected to the operation valve upstream of or downstream of the operation valve and configured to control hydraulic fluid pressure acting from the operation valve on the traveling pump; wherein the controller may be configured or programmed to perform the shift shock reduction control of reducing the amount of hydraulic fluid supply from the traveling pump to the traveling motor by reducing the opening of the actuation valve by outputting a control signal to the actuation valve when the shift-down switching is performed, the first processor may be configured or programmed to, based on a drop amount that is a difference between a target number of revolutions of the prime mover and an actual number of revolutions of the prime mover, compute a first reduction amount that is an amount of reduction in opening of the actuation valve in the shift shock reduction control, the second processor may be configured or programmed to, based on the degree of straight traveling of the machine body, compute a second reduction amount that is an amount of reduction in opening of the actuation valve in the shift shock reduction control, and the reduction controller may be configured or programmed to perform the shift shock reduction control of reducing the amount of hydraulic fluid supply from the traveling pump to the traveling motor by reducing the opening of the actuation valve based on a reduction amount that is either the first reduction amount computed by the first processor or the second reduction amount computed by the second processor, whichever is larger in absolute value.

The actuation valve may be a valve whose opening increases as a control value corresponding to the control signal increases and whose opening decreases as the control value decreases, and the controller may be configured or programmed to, based on the degree of straight traveling of the machine body, set a reduction amount of the control value as the amount of reduction in opening of the actuation valve, and compute a reduced value in the shift shock reduction control based on the reduction amount.

In a reduction interval till the control value reaching the reduced value, the controller may be configured or programmed to set a first rate of reduction in the control value to be constant from a starting point of the reduction interval to an ending point of the reduction interval.

In a reduction interval till the control value reaching the reduced value, the controller may be configured or programmed to set a second rate of reduction in the control value in an interval from a starting point of the reduction interval to a midpoint between the starting point and an ending point, to be higher than a third rate of reduction in the control value in an interval from the midpoint to the ending point of the reduction interval.

The controller may be configured or programmed to vary timing of switching the traveling switching valve from the first state to the second state according to the degree of straight traveling.

The controller may be configured or programmed to set the reduction amount to be larger as the degree of straight traveling is higher and set the reduction amount to be smaller as the degree of straight traveling is lower.

The working machine according to an aspect of the present disclosure may further include: a first traveling device on a left side of the machine body; and a second traveling device on a right side of the machine body, wherein the traveling motor may include a first traveling motor to transmit power for traveling to the first traveling device and a second traveling motor to transmit power for traveling to the second traveling device, the traveling pump may rotate the first traveling motor and the second traveling motor, and the traveling switching valve may switch a rotation speed of the first traveling motor and a rotation speed of the second traveling motor between the first state and the second state.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

FIG. 8 is a diagram illustrating a data table.

DETAILED DESCRIPTION OF THE PREFERRED EMBODIMENTS

Figure 1:
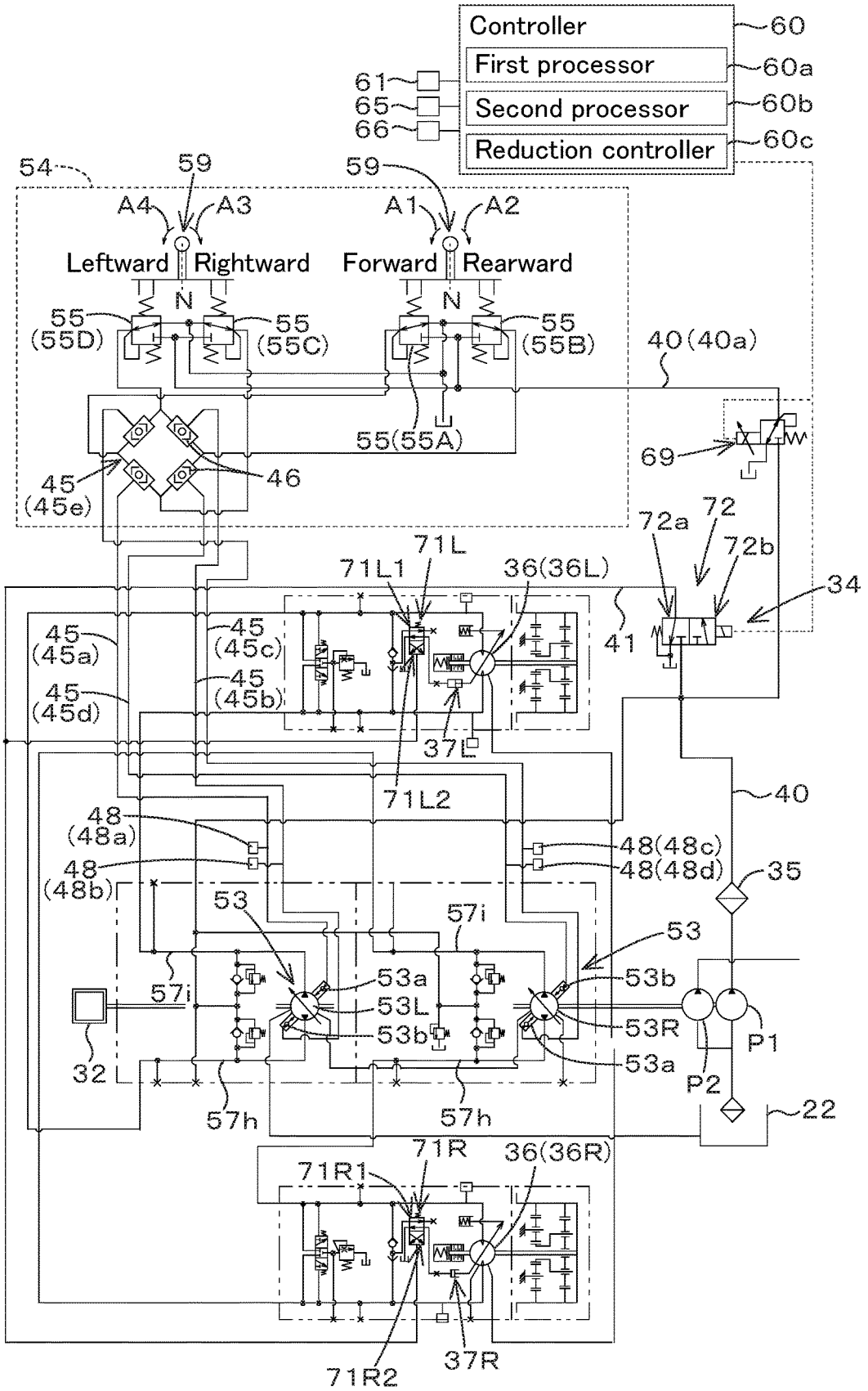
FIG. 1 is a diagram illustrating a hydraulic system (hydraulic circuit) of a working machine according to a first embodiment.

The preferred embodiments will now be described with reference to the accompanying drawings, wherein like reference numerals designate corresponding or identical elements throughout the various drawings. The drawings are to be viewed in an orientation in which the reference numerals are viewed correctly.

A working machine, and a hydraulic system of the working machine, according some preferred embodiments of the present disclosure will now be described while referring to the drawings, where necessary.

First Embodiment

Figure 12:
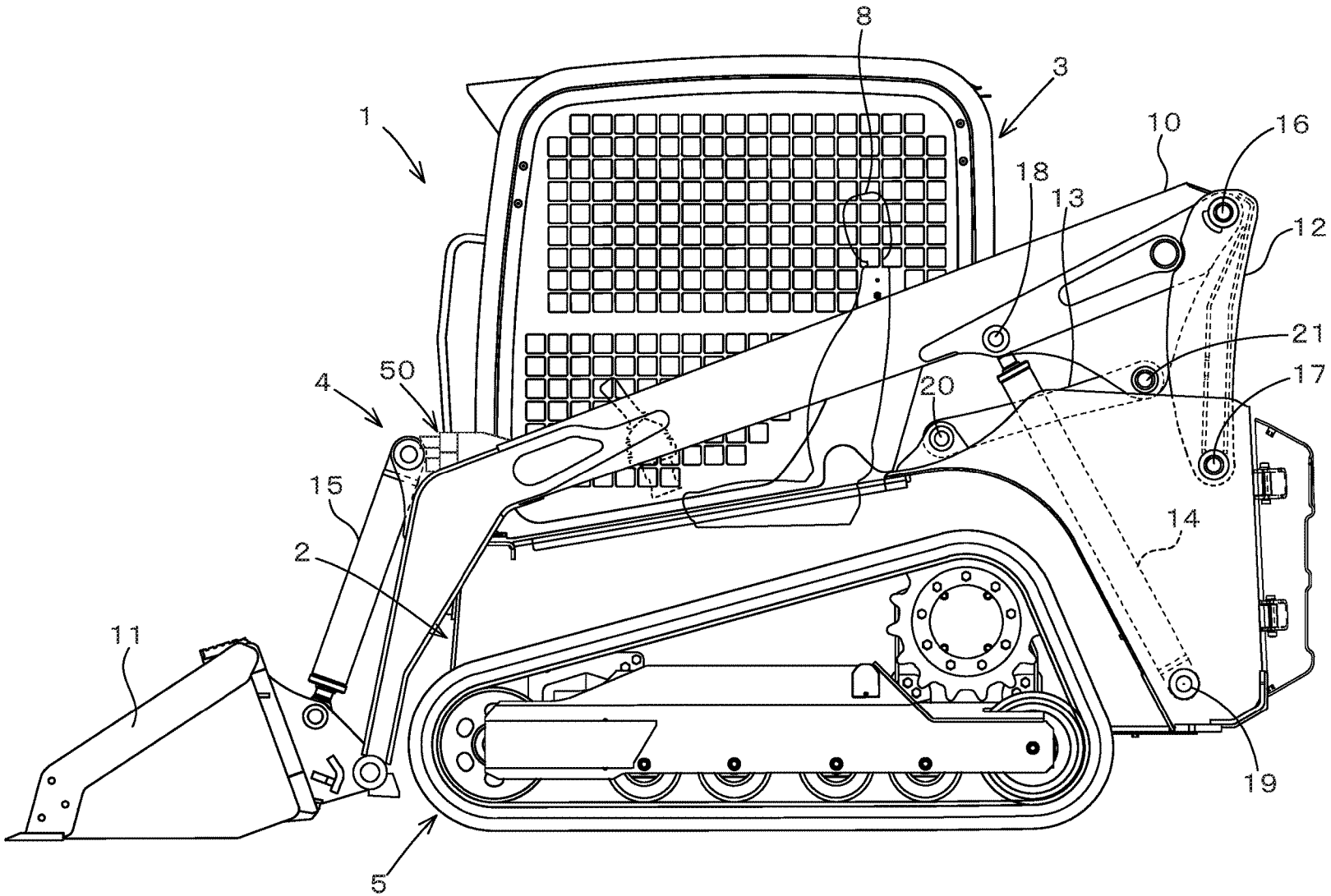
FIG. 12 is a side view of a track loader that is an example of the working machine.

FIG. 12 is a side view of an example of a working machine according to the present disclosure. In FIG. 12, a compact track loader is illustrated as an example of a working machine. However, the working machine according to the present disclosure is not limited to a compact track loader. It may be any other kind of loader machine such as, for example, a skid-steer loader. It may be any kind of working machine other than a loader machine.

As illustrated in FIG. 12, the working machine 1 includes a machine body 2, a cabin 3, a working device 4, and traveling devices 5. In a first embodiment of the present disclosure, the term "forward" will be used for referring to a direction which an operator seated on an operator's seat 8 of the working machine 1 faces (leftward in FIG. 12), and the term "rearward" will be used for referring to the opposite direction thereof (rightward in FIG. 12). The term "leftward" will be used for referring to a direction going toward the left side as viewed from the operator (direction toward the near side in FIG. 12), and the term "rightward" will be used for referring to a direction going toward the right side as viewed from the operator (direction toward the far side in FIG. 12). A horizontal direction orthogonal to a front-rear direction will be referred to as "machine-body width direction". A direction going rightward or leftward from the center of the machine body 2 will be referred to as "machine-body outward direction". In other words, the machine-body outward direction is a direction going away from the machine body 2 as a kind of the machine-body width direction. The direction that is the opposite of the machine-body outward direction will be referred to as "machine-body inward direction". In other words, the machine-body inward direction is a direction going toward the machine body 2 as a kind of the machine-body width direction.

The cabin 3 is mounted on the machine body 2. The operator's seat 8 is provided inside the cabin 3. The working device 4 is mounted on the machine body 2. The traveling devices 5 are provided outside the machine body 2. A prime mover 32 is mounted on a rear portion inside the machine body 2.

The working device 4 includes booms 10, a bucket 11, which is an example of a working tool, lift links 12, control links 13, boom cylinders 14, and bucket cylinders 15.

The booms 10 are provided to the left and right of the cabin 3 respectively such that they can be moved pivotally up and down. The bucket 11 is provided on the distal end (front end) of the booms 10 such that it can be moved pivotally up and down. The lift links 12 and the control links 13 support the base (rear portion) of the booms 10 to enable pivotal up-and-down motion of the booms 10. The boom cylinders 14 raise and lower the booms 10 by their extending-and-retracting motion. The bucket cylinders 15 move the bucket 11 pivotally by their extending-and-retracting motion.

The front portion of the left boom 10 and the front portion of the right boom 10 are coupled to each other via a non-standard-shaped coupling pipe. The bases (rear portion) of the booms 10 are coupled to each other via a round coupling pipe.

The lift links 12, the control links 13, and the boom cylinders 14 are provided on the left and right sides with respect to the machine body 2 respectively for the left and right booms 10.

The lift link 12 is provided in vertical orientation on the rear portion of the base of each of the booms 10. The top portion (one end) of each of the lift links 12 is pivotally supported on a pivot (for example, a first pivot shaft 16) near the rear end of the base of the corresponding one of the booms 10 in such a way as to be able to rotate on its horizontal axis. The bottom portion (the other end) of each of the lift links 12 is pivotally supported on a pivot (for example, a second pivot shaft 17) near the rear end of the machine body 2 in such a way as to be able to rotate on its horizontal axis. The second pivot shaft 17 is provided under the first pivot shaft 16.

The top portion of each of the boom cylinders 14 is pivotally supported on a pivot (for example, a third pivot shaft 18) in such a way as to be able to rotate on its horizontal axis. The third pivot shaft 18 is provided on the front portion of the base of each of the booms 10. The bottom portion of each of the boom cylinders 14 is pivotally supported on a pivot (for example, a fourth pivot shaft 19) in such a way as to be able to rotate on its horizontal axis. The fourth pivot shaft 19 is provided in the lower rear portion of the machine body 2 below the third pivot shaft 18.

The control links 13 are provided in front of the lift links 12. One end of each of the control links 13 is pivotally supported on a pivot (for example, a fifth pivot shaft 20) in such a way as to be able to rotate on its horizontal axis. The fifth pivot shaft 20 is provided on the machine body 2 in front of the lift links 12. The other end of each of the control links 13 is pivotally supported on a pivot (for example, a sixth pivot shaft 21) in such a way as to be able to rotate on its horizontal axis. The sixth pivot shaft 21 is provided on the booms 10 ahead of, and above, the second pivot shaft 17.

The extending-and-retracting motion of the boom cylinders 14 causes the booms 10 to move pivotally up and down around the first pivot shaft 16 while being supported at their base portion by the lift links 12 and the control links 13. The control links 13 move pivotally up and down around the fifth pivot shaft 20 when the booms 10 move pivotally up and down. The lift links 12 move pivotally forward and rearward around the second pivot shaft 17 when the control links 13 move pivotally up and down.

An alternative working tool can be attached to the front end of the booms 10 in place of the bucket 11. The alternative working tool is an attachment (auxiliary attachment) such as, for example, a hydraulic crusher, a hydraulic breaker, an angle broom, an earth auger, a pallet fork, a sweeper, a mower, or a snow blower.

A connection member 50 is provided on the front portion of the left boom 10. The connection member 50 is a device for connecting hydraulic equipment provided on the auxiliary attachment to a first conduit member such as a pipe provided on the boom 10. Specifically, the first conduit member can be connected to one end of the connection member 50, and a second conduit member connected to the hydraulic equipment of the auxiliary attachment can be connected to the other end thereof. The connection enables a hydraulic fluid flowing through the first conduit member to be supplied to the hydraulic equipment through the second conduit member.

The bucket cylinders 15 are disposed near the front portion of the booms 10 respectively. The extending-and-retracting motion of the bucket cylinders 15 causes pivotal motion of the bucket 11.

In the first embodiment, a crawler-type (including semi-crawler-type) traveling system is adopted for each of the traveling device on the left side and the traveling device on the right side (left traveling device, right traveling device) 5. A wheeled-type traveling system including front and rear wheels may be adopted instead.

The prime mover 32 is an internal combustion engine such as a diesel engine or a gasoline engine, or an electric motor, etc. In the first embodiment, the prime mover 32 is a diesel engine, but is not limited thereto.

Next, a hydraulic system of the working machine 1 will now be explained.

As illustrated in FIG. 1, a hydraulic system of the working machine 1 according to the first embodiment is capable of driving the traveling devices 5 The hydraulic system of the working machine 1 includes traveling pumps 53 (a first traveling pump 53L and a second traveling pump 53R) and traveling motors 36 (a first traveling motor 36L and a second traveling motor 36R).

The first traveling pump 53L and the second traveling pump 53R are pumps configured to be driven by the power of the prime mover 32. Specifically, the first traveling pump 53L and the second traveling pump 53R are swash-plate variable displacement axial pumps configured to be driven by the power of the prime mover 32. Each of the first traveling pump 53L and the second traveling pump 53R includes a pressure receiver 53*a* and a pressure receiver 53*b* on which pilot pressure acts. The angle of its swash plate is changed by the pilot pressure acting on the pressure receiver 53*a*, 53*b*. It is possible to change the output (hydraulic fluid delivery amount) and hydraulic fluid delivery direction of the first, second traveling pump 53L, 53R by changing the angle of the swash plate.

The first traveling pump 53L is connected to the first traveling motor 36L through a circulation fluid passage 57*h*. A hydraulic fluid delivered by the first traveling pump 53L is supplied to the first traveling motor 36L. The second traveling pump 53R is connected to the second traveling motor 36R through a circulation fluid passage 57*i*. A hydraulic fluid delivered by the second traveling pump 53R is supplied to the second traveling motor 36R. The first traveling motor 36L is a motor configured to transmit power to the drive shaft of the traveling device 5 provided on the left side of the machine body 2. The first traveling motor 36L is able to rotate using the hydraulic fluid delivered from the first traveling pump 53L. The rotation speed (number of revolutions) of the first traveling motor 36L can be changed by changing the flow rate of the hydraulic fluid. A swash plate switching cylinder 37L is connected to the first traveling motor 36L. The rotation speed (number of revolutions) of the first traveling motor 36L can be changed also by the extending-and-retracting motion of the swash plate switching cylinder 37L toward one side or the other side. Specifically, the number of revolutions of the first traveling motor 36L is set to LOW (a first speed range up to a first maximum or utmost speed; hereinafter simply referred to as "first speed", where appropriate) when the swash plate switching cylinder 37L is retracted. The number of revolutions of the first traveling motor 36L is set to HIGH (a second speed range up to a second maximum or utmost speed higher than the first maximum or utmost speed; hereinafter simply referred to as "second speed", where appropriate) when the swash plate switching cylinder 37L is extended. That is, the number of revolutions of the first traveling motor 36L is switchable between the first speed, which is LOW, and the second speed, which is HIGH.

The second traveling motor 36R is a motor configured to transmit power to the drive shaft of the traveling device 5 provided on the right side of the machine body 2. The second traveling motor 36R is able to rotate using the hydraulic fluid delivered from the second traveling pump 53R. The rotation speed (number of revolutions) of the second traveling motor 36R can be changed by changing the flow rate of the hydraulic fluid. A swash plate switching cylinder 37R is connected to the second traveling motor 36R. The rotation speed (number of revolutions) of the second traveling motor 36R can be changed also by the extending-and-retracting motion of the swash plate switching cylinder 37R toward one side or the other side. Specifically, the number of revolutions of the second traveling motor 36R is set to LOW (the first speed) when the swash plate switching cylinder 37R is retracted. The number of revolutions of the second traveling motor 36R is set to HIGH (the second speed) when the swash plate switching cylinder 37R is extended. That is, the number of revolutions of the second traveling motor 36R is switchable between the first speed, which is LOW, and the second speed, which is HIGH.

As illustrated in FIG. 1, the hydraulic system of the working machine 1 includes a traveling switching valve 34. The traveling switching valve 34 is switchable between a first state, in which the rotation speeds (numbers of revolutions) of the traveling motors (the first traveling motor 36L and the second traveling motor 36R) can be increased up to the first maximum or utmost speed, and a second state, in which the rotation speeds (numbers of revolutions) of the traveling motors (the first traveling motor 36L and the second traveling motor 36R) can be increased up to the second maximum or utmost speed higher than the first maximum or utmost speed. The traveling switching valve 34 includes first switching valves 71L and 71R and a second switching valve 72.

The first switching valve 71L is connected to the swash plate switching cylinder 37L of the first traveling motor 36L through a fluid passage. The first switching valve 71L is a two-position switching valve switchable between a first position 71L1 and a second position 71L2. The swash plate switching cylinder 37L is retracted when the first switching valve 71L is put into the first position 71L1. The swash plate switching cylinder 37L is extended when the first switching valve 71L is put into the second position 71L2.

The first switching valve 71R is connected to the swash plate switching cylinder 37R of the second traveling motor 36R through a fluid passage. The second switching valve 71R is a two-position switching valve switchable between a first position 71R1 and a second position 71R2. The swash plate switching cylinder 37R is retracted when the first switching valve 71R is put into the first position 71R1. The swash plate switching cylinder 37R is extended when the first switching valve 71R is put into the second position 71R2.

The second switching valve 72 is a solenoid valve configured to switch the first switching valves 71L and 71R. The second switching valve 72 is a two-position switching valve switchable between a first position 72*a* and a second position 72*b* by energization. The second switching valve 72 is connected to the first switching valves 71L and 71R through a fluid passage 41. The second switching valve 72, when put into the first position 72*a*, switches the first switching valve 71L into the first position 71L1 and the first switching valve 71R into the first position 71R1. The second switching valve 72, when put into the second position 72*b*, switches the first switching valve 71L into the second position 71L2 and the first switching valve 71R into the second position 71R2.

That is, when the second switching valve 72 is in the first position 72*a*, the first switching valve 71L is in the first position 71L1, and the first switching valve 71R is in the first position 71R1, and, in this case, the traveling switching valve 34 is in the first state, and the rotation speed of the traveling motor 36 (the first, second traveling motor 36L, 36R) is the first speed. When the second switching valve 72 is in the second position 72*b*, the first switching valve 71L is in the second position 71L2, and the first switching valve 71R is in the second position 71R2, and, in this case, the traveling switching valve 34 is in the second state, and the rotation speed of the traveling motor 36 (the first, second traveling motor 36L, 36R) is the second speed.

Therefore, it is possible to switch the rotation speed of the traveling motor 36 (the first, second traveling motor 36L, 36R) between the first speed, which is LOW, and the second speed, which is HIGH, by operating the traveling switching valve 34.

Switching between the first speed and the second speed of the traveling motor 36 can be performed using a switcher. The switcher is, for example, a selector switch 61 connected to a controller 60 and operable by the operator. The switcher (selector switch 61) is able to perform shift-up/down switching. The shift-up switching is a shift from the first speed (first state) to the second speed (second state). The shift-down switching is a shift from the second speed (second state) to the first speed (first state).

As illustrated in FIG. 1, the hydraulic system of the working machine 1 includes the controller 60. The controller 60 includes a semiconductor such as a CPU or an MPU, an electric/electronic circuit, etc. Based on switching operation of the selector switch 61, the controller 60 switches the traveling switching valve 34. The selector switch 61 is a push switch. For example, the selector switch 61, when pushed while the traveling motor 36 is rotating at the first speed, outputs a command for switching the traveling motor 36 to the second speed (a command for putting the traveling switching valve 34 into the second state) to the controller 60. The selector switch 61, when pushed while the traveling motor 36 is rotating at the second speed, outputs a command for switching the traveling motor 36 to the first speed (a command for putting the traveling switching valve 34 into the first state) to the controller 60. The selector switch 61 may be a push switch that can be held ON/OFF. The selector switch 61, when held OFF, outputs a command for keeping the traveling motor 36 at the first speed. The selector switch 61, when held ON, outputs a command for keeping the traveling motor 36 at the second speed.

The controller 60 puts the traveling switching valve 34 into the first state by de-energizing the solenoid of the second switching valve 72 when a command for putting the traveling switching valve 34 into the first state is acquired. The controller 60 puts the traveling switching valve 34 into the second state by energizing the solenoid of the second switching valve 72 when a command for putting the traveling switching valve 34 into the second state is acquired.

The hydraulic system of the working machine 1 includes a first hydraulic pump P1, a second hydraulic pump P2, and a traveling manipulator 54. The first hydraulic pump P1 is a constant-displacement-type gear pump configured to be driven by the power of the prime mover 32. The first hydraulic pump P1 is capable of delivering a hydraulic fluid contained in a tank 22. More particularly, the first hydraulic pump P1 delivers a hydraulic fluid to be used mainly for control. For the sake of description, the tank 22 containing the hydraulic fluid may be referred to as "hydraulic fluid tank". Of the hydraulic fluid delivered from the first hydraulic pump P1, the hydraulic fluid to be used for control may be referred to as "pilot fluid", and the pressure of the pilot fluid may be referred to as "pilot pressure".

The second hydraulic pump P2 is a constant-displacement-type gear pump configured to be driven by the power of the prime mover 32. The second hydraulic pump P2 is capable of delivering the hydraulic fluid contained in the tank 22. For example, the second hydraulic pump P2 supplies the hydraulic fluid to work fluid passages. For example, the second hydraulic pump P2 supplies the hydraulic fluid to the boom cylinders 14 for causing the booms 10 to operate, the bucket cylinders 15 for causing the bucket 11 to operate, and a control valve (flow rate control valve) for controlling the operation of an auxiliary hydraulic actuator.

The traveling manipulator 54 is a device for manipulating the traveling pumps 53 (the first traveling pump 53L and the second traveling pump 53R). The traveling manipulator 54 is able to change the angles of the swash plates of the traveling pumps 53 (swash-plate angles). The traveling manipulator 54 includes an operation member 59 such as an operation lever and a plurality of operation valves 55.

The operation member 59 is an operation lever supported on the operation valves 55 and configured to be swung in the left-right direction (the machine-body width direction) or the front-rear direction selectively. That is, when the neutral position N of the operation member 59 is defined as its home position, the operation member 59 can be operated rightward and leftward from the neutral position N and forward and rearward from the neutral position N. In other words, the operation member 59 can be swung in at least four directions from the neutral position N defined as its home position. For the sake of description, the two directions going forward and rearward, namely, the front-rear direction, may be hereinafter referred to as "first direction". The two directions going rightward and leftward, namely, the left-right direction (the machine-body width direction), may be hereinafter referred to as "second direction".

The plurality of operation valves 55 is manipulated by operating the operation member 59 that is common to them, that is, a single operation member. The plurality of operation valves 55 operates based on the operator's swing motion of the operation member 59. A delivery fluid passage 40 is connected to the plurality of operation valves 55. The hydraulic fluid (pilot fluid) delivered from the first hydraulic pump P1 can be supplied to the plurality of operation valves 55 through the delivery fluid passage 40. The plurality of operation valves 55 includes an operation valve 55A, an operation valve 55B, an operation valve 55C, and an operation valve 55D.

When the operation member 59 is swung forward (operated forward) as one of the front-rear direction (first direction), the pressure of a hydraulic fluid which the operation valve 55A outputs changes in accordance with an amount of the forward operation. When the operation member 59 is swung rearward (operated rearward) as the other of the front-rear direction (first direction), the pressure of a hydraulic fluid which the operation valve 55B outputs changes in accordance with an amount of the rearward operation. When the operation member 59 is swung rightward (operated rightward) as one of the left-right direction (second direction), the pressure of a hydraulic fluid which the operation valve 55C outputs changes in accordance with an amount of the rightward operation. When the operation member 59 is swung leftward (operated leftward) as the other of the left-right direction (second direction), the pressure of a hydraulic fluid which the operation valve 55D outputs changes in accordance with an amount of the leftward operation.

The plurality of operation valves 55 is connected to the traveling pumps 53 (the first traveling pump 53L and the second traveling pump 53R) through a traveling fluid passage 45. In other words, the traveling pump 53 (the first, second traveling pump 53L, 53R) is hydraulic equipment that is operable using the hydraulic fluid outputted from the operation valve 55 (the operation valve 55A, 55B, 55C, 55D).

The traveling fluid passage 45 includes a first traveling fluid passage 45*a*, a second traveling fluid passage 45*b*, a third traveling fluid passage 45*c*, a fourth traveling fluid passage 45*d*, and a fifth traveling fluid passage 45*e*. The first traveling fluid passage 45*a* is a fluid passage connected to the pressure receiver 53*a* of the first traveling pump 53L. The second traveling fluid passage 45*b* is a fluid passage connected to the pressure receiver 53*b* of the first traveling pump 53L. The third traveling fluid passage 45*c* is a fluid passage connected to the pressure receiver 53*a* of the second traveling pump 53R. The fourth traveling fluid passage 45*d* is a fluid passage connected to the pressure receiver 53*b* of the second traveling pump 53R. The fifth traveling fluid passage 45*e* is a fluid passage for connection of the plurality of operation valves 55 to the first traveling fluid passage 45*a*, the second traveling fluid passage 45*b*, the third traveling fluid passage 45*c*, and the fourth traveling fluid passage 45*d*.

When the operation member 59 is swung forward (in the direction indicated by an arrow A1 in FIG. 1), the operation valve 55A is manipulated, and pilot pressure is outputted from the operation valve 55A. The pilot pressure acts on the pressure receiver 53*a* of the first traveling pump 53L through the first traveling fluid passage 45*a* and acts on the pressure receiver 53*a* of the second traveling pump 53R through the third traveling fluid passage 45*c*. This changes the swash-plate angles of the first traveling pump 53L and the second traveling pump 53R to cause the first traveling motor 36L and the second traveling motor 36R to rotate in the normal direction (forward rotation), thereby causing the working machine 1 to travel straight forward.

When the operation member 59 is swung rearward (in the direction indicated by an arrow A2 in FIG. 1), the operation valve 55B is manipulated, and pilot pressure is outputted from the operation valve 55B. The pilot pressure acts on the pressure receiver 53*b* of the first traveling pump 53L through the second traveling fluid passage 45*b* and acts on the pressure receiver 53*b* of the second traveling pump 53R through the fourth traveling fluid passage 45*d*. This changes the swash-plate angles of the first traveling pump 53L and the second traveling pump 53R to cause the first traveling motor 36L and the second traveling motor 36R to rotate in the reverse direction (reverse rotation), thereby causing the working machine 1 to travel straight rearward.

When the operation member 59 is swung rightward (in the direction indicated by an arrow A3 in FIG. 1), the operation valve 55C is manipulated, and pilot pressure is outputted from the operation valve 55C. The pilot pressure acts on the pressure receiver 53*a* of the first traveling pump 53L through the first traveling fluid passage 45*a* and acts on the pressure receiver 53*b* of the second traveling pump 53R through the fourth traveling fluid passage 45*d*. This changes the swash-plate angles of the first traveling pump 53L and the second traveling pump 53R to cause the first traveling motor 36L to rotate in the normal direction and the second traveling motor 36R to rotate in the reverse direction, thereby causing the working machine 1 to make a turn to the right.

When the operation member 59 is swung leftward (in the direction indicated by an arrow A4 in FIG. 1), the operation valve 55D is manipulated, and pilot pressure is outputted from the operation valve 55D. The pilot pressure acts on the pressure receiver 53*a* of the second traveling pump 53R through the third traveling fluid passage 45*c* and acts on the pressure receiver 53*b* of the first traveling pump 53L through the second traveling fluid passage 45*b*. This changes the swash-plate angles of the first traveling pump 53L and the second traveling pump 53R to cause the first traveling motor 36L to rotate in the reverse direction and the second traveling motor 36R to rotate in the normal direction, thereby causing the working machine 1 to make a turn to the left.

When the operation member 59 is swung in an oblique direction, the rotation direction and the rotation speed of each of the first traveling motor 36L and the second traveling motor 36R are determined based on differential pressure between pilot pressure acting on the pressure receiver 53*a* and pilot pressure acting on the pressure receiver 53*b*, and the working machine 1 makes a turn to the right or a turn to the left while traveling forward or rearward.

Specifically, the working machine 1 turns as follows. When the operation member 59 is swung obliquely forward to the left, the working machine 1 makes a turn to the left while traveling forward at a speed corresponding to the swing angle of the operation member 59. When the operation member 59 is swung obliquely forward to the right, the working machine 1 makes a turn to the right while traveling forward at a speed corresponding to the swing angle of the operation member 59. When the operation member 59 is swung obliquely rearward to the left, the working machine 1 makes a turn to the left while traveling rearward at a speed corresponding to the swing angle of the operation member 59. When the operation member 59 is swung obliquely rearward to the right, the working machine 1 makes a turn to the right while traveling rearward at a speed corresponding to the swing angle of the operation member 59.

An accelerator 65 for setting a target number of revolutions of the prime mover 32 is connected to the controller 60. The accelerator 65 is provided near the operator's seat 8. The accelerator 65 is an accelerator lever supported pivotally, an accelerator pedal supported pivotally, an accelerator potentiometer supported rotatably, an accelerator slider supported slidably, or the like. The accelerator 65 is not limited to these examples. A revolution detector 66 for detecting an actual number of revolutions of the prime mover 32 is connected to the controller 60. Detection by the revolution detector 66 enables the controller 60 to obtain information on the actual number of revolutions of the prime mover 32. Based on an operation amount of the accelerator 65, the controller 60 sets the target number of revolutions and controls the actual number of revolutions to make it equal to the set target number of revolutions.

When the traveling switching valve 34 is switched from the second state (second speed) to the first state (first speed), that is, when the rotation speed of the traveling motor 36 is decreased from the second speed to the first speed (which may be referred to as "a shift-down switching herein), the controller 60 is configured or programmed to control an amount of hydraulic fluid supply from the traveling pumps 53 (the first traveling pump 53L and the second traveling pump 53R) to the traveling motors 36 (the first traveling motor 36L and the second traveling motor 36R) to ease or reduce shock to the traveling devices 5 due to the shift-down switching. This control process performed by the controller 60 may be referred to simply as "a shift shock reduction control" herein, in which the amount of hydraulic fluid supply from the traveling pumps 53 to the traveling motors 36 is reduced to ease the shock to the traveling devices 5 at the shift-down switching of the traveling switching valve 34.

The controller 60 includes a first processor 60*a*, a second processor 60*b*, and a reduction controller 60*c*.

Based on a drop amount that is a difference between a target number of revolutions of the prime mover 32 and an actual number of revolutions of the prime mover 32, the first processor 60*a* computes a first reduction amount for reducing an amount of hydraulic fluid supply from the traveling pumps 53 to the traveling motors 36 in shift shock reduction control. For example, the first processor 60*a* has a software configuration whose functions are realized by running, by a CPU of the controller 60, a first control program for computing the first reduction amount. The first processor 60*a* may have a configuration including a semiconductor such as a CPU or an MPU, an electric/electronic circuit, etc. Specifically, based on the drop amount that is the difference between the target number of revolutions of the prime mover 32 and the actual number of revolutions of the prime mover 32, the first processor 60*a* computes the first amount of reduction in the number of revolutions of the prime mover 32 in shift shock reduction control.

Based on a degree of straight traveling of the machine body 2, the second processor 60*b* computes a second reduction amount for reducing an amount of hydraulic fluid supply from the traveling pumps 53 to the traveling motors 36 in shift shock reduction control. For example, the second processor 60*b* has a software configuration whose functions are realized by running, by a CPU of the controller 60, a second control program for computing the second reduction amount. The second processor 60*b* may have a configuration including a semiconductor such as a CPU or an MPU, an electric/electronic circuit, etc. Specifically, based on the degree of straight traveling of the machine body 2, the second processor 60*b* computes the second amount of reduction in the number of revolutions of the prime mover 32 in shift shock reduction control.

Based on the first reduction amount computed by the first processor 60*a* or the second reduction amount computed by the second processor 60*b*, whichever is larger in absolute value, the reduction controller 60*c* performs shift shock reduction control. For example, the reduction controller 60*c* has a software configuration whose functions are realized by running, by a CPU of the controller 60, a third control program for performing shift shock reduction control based on the first reduction amount or the second reduction amount, whichever is larger in absolute value. The reduction controller 60*c* may have a configuration including a semiconductor such as a CPU or an MPU, an electric/electronic circuit, etc. Specifically, the reduction controller 60*c* performs shift shock reduction control of reducing an amount of hydraulic fluid supply from the traveling pumps 53 to the traveling motors 36 by reducing the number of revolutions of the prime mover 32 based on the first reduction amount computed by the first processor 60*a* or the second reduction amount computed by the second processor 60*b*, whichever is larger in absolute value.

With reference to the flowchart of FIG. 2, shift shock reduction control at the time of shift-down operation will now be explained in detail.

When the selector switch (SW) 61 is operated by the operator, the controller 60 determines whether shifting down the speed stage of the machine body 2 (the working machine 1) is commanded or not (S11). Specifically, the selector switch 61, if pushed by the operator while the traveling motor is rotating at the first speed, outputs a shift-up command (a command to shift to "second") for switching from the first state (the first speed) to the second state (the second speed) to the controller 60. The selector switch 61, if pushed by the operator while the traveling motor is rotating at the second speed, outputs a shift-down command (a command to shift to "first") for switching from the second state (the second speed) to the first state (the first speed) to the controller 60. In an example described here, it is assumed that the selector switch 61 outputs a shift-down command (a command to shift to "first"). Upon receiving the command to shift to "first", the controller 60 determines that shifting down the speed stage of the machine body 2 (the working machine 1) is commanded (S11: Yes), and the process proceeds to S12. If the controller 60 determines that shifting down the speed stage of the machine body 2 (the working machine 1) is not commanded (S11: No), the process returns to S11, and the controller 60 waits until receiving a shift-down command (a command to shift to "first").

First Arithmetic Operator 60*a*

When the controller 60 receives a shift-down command (a command to shift to "first"), based on the drop amount that is the difference between the target number of revolutions of the prime mover 32 and the actual number of revolutions of the prime mover 32, the first processor 60*a* computes the first amount of reduction in the number of revolutions of the prime mover 32 in shift shock reduction control (S12).

Figure 3:
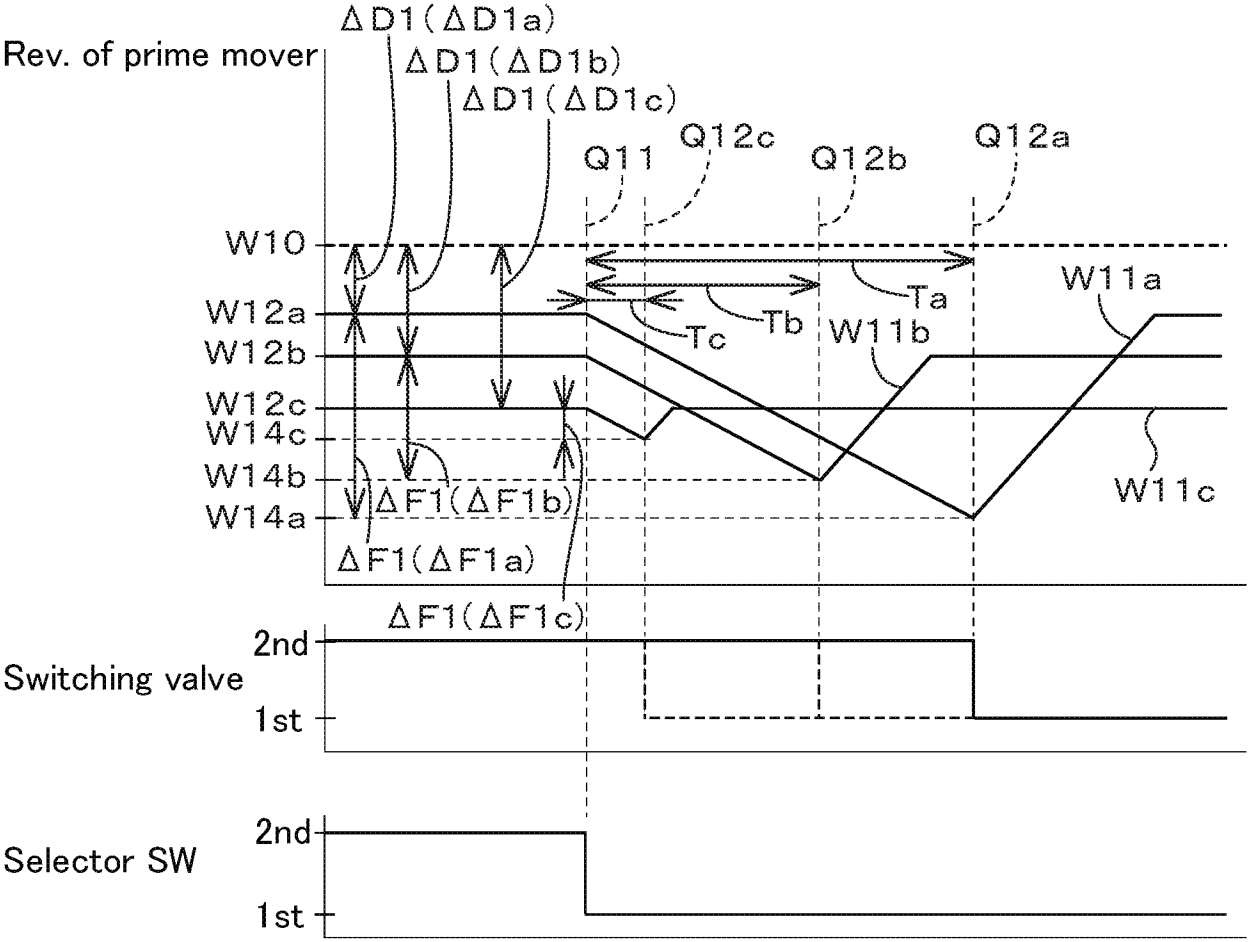
FIG. 3 is a diagram illustrating a relationship between the number of revolutions of a prime mover and the switching of a traveling motor in a case where the speed of the traveling motor is decreased.

FIG. 3 is a diagram illustrating a relationship between the number of revolutions of the prime mover (a target number of revolutions W10, an actual number of revolutions W12a, W12b, W12c) and the switching of the traveling motor in a case where shift shock reduction control at the time of shift-down operation is performed. As illustrated in FIG. 3, based on a drop amount ΔD1 that is a difference between a target number of revolutions W10 of the prime mover 32 and an actual number of revolutions W12a, W12b, W12c of the prime mover 32, the first processor 60*a* of the controller 60 computes a first amount of reduction ΔF1 in the number of revolutions of the prime mover 32 in shift shock reduction control.

When the controller 60 receives a command to shift to "first", the first processor 60*a* computes the drop amount ΔD1 (ΔD1a, ΔD1b, ΔD1c) by subtracting the actual number of revolutions W12a, W12b, W12c from the target number of revolutions W10. After computing the drop amount ΔD1 (ΔD1a, ΔD1b, ΔD1c), based on the drop amount ΔD1 (ΔD1a, ΔD1b, ΔD1c), the first processor 60*a* computes the first reduction amount ΔF1 (ΔF1a, ΔF1b, ΔF1c). In the computation of the first reduction amount ΔF1, the first processor 60*a* outputs a large value of the first reduction amount ΔF1 when the drop amount ΔD1 is small, and outputs a small value of the first reduction amount ΔF1 when the drop amount ΔD1 is large.

For example, the first processor 60*a* computes the first reduction amount to be ΔF1a when the drop amount is ΔD1a at a point in time Q11. Alternatively, the first processor 60*a* computes the first reduction amount to be ΔF1b when the drop amount is ΔD1b at the point in time Q11. Alternatively, the first processor 60*a* computes the first reduction amount to be ΔF1c when the drop amount is ΔD1c at the point in time Q11.

In this way, depending on the value of the drop amount ΔD1 (ΔD1a, ΔD1b, ΔD1c) at the point in time Q11, the first processor 60*a* computes the value of the first reduction amount ΔF1 (ΔF1a, ΔF1b, ΔF1c) (S12).

Second Arithmetic Operator 60*b*

Referring back to FIG. 2, when the controller 60 receives a shift-down command (a command to shift to "first"), based on the degree of straight traveling of the machine body 2, the second processor 60*b* computes the second amount of reduction in the number of revolutions of the prime mover 32 in shift shock reduction control (S13).

When shift shock reduction control at the time of shift-down operation is performed, based on the degree of straight traveling of the working machine 1 (the machine body 2), the second processor 60*b* of the controller 60 computes the second amount of reduction in the number of revolutions of the prime mover 32. The degree of straight traveling can be calculated based on hydraulic fluid pressure at the traveling fluid passage 45.

As illustrated in FIG. 1, a pressure detector 48 configured to detect hydraulic fluid pressure (pilot pressure) at the traveling fluid passage 45 is connected to the traveling fluid passage 45. The pressure detector 48 includes a first pressure detector 48*a*, a second pressure detector 48*b*, a third pressure detector 48*c*, and a fourth pressure detector 48*d*. The first pressure detector 48*a*, the second pressure detector 48*b*, the third pressure detector 48*c*, and the fourth pressure detector 48*d* are connected to the second processor 60*b*.

The first pressure detector 48*a* is a sensor capable of detecting first pilot pressure lf(t) that is hydraulic fluid pressure at the first traveling fluid passage 45*a*. The second pressure detector 48*b* is a sensor capable of detecting second pilot pressure lb(t) that is hydraulic fluid pressure at the second traveling fluid passage 45*b*. The third pressure detector 48*c* is a sensor capable of detecting third pilot pressure rf(t) that is hydraulic fluid pressure at the third traveling fluid passage 45*c*. The fourth pressure detector 48*d* is a sensor capable of detecting fourth pilot pressure rb(t) that is hydraulic fluid pressure at the fourth traveling fluid passage 45*d*.

As expressed by formulae (1) and (2), based on the first pilot pressure lf(t), the second pilot pressure lb(t), the third pilot pressure rf(t), and the fourth pilot pressure rb(t), the second processor 60*b* calculates a degree of straight traveling $S_{Bratio}(t)$ and a degree of straight traveling $S_{Fratio}(t)$. In a case where a ratio (rf(t)/lf(t)) is not within a predetermined range, the second processor 60*b* takes the first pilot pressure lf(t) or the third pilot pressure rf(t), whichever is higher, as a first straight traveling value $pv_{Bpivot}$. In a case where a ratio (rb(t)/lb(t)) is not within a predetermined range, the second processor 60*b* takes the second pilot pressure lb(t) or the fourth pilot pressure rb(t), whichever is higher, as a second straight traveling value $pv_{Fpivot}$.

$$S_{Fratio(t)} = \left(\frac{rf_{(t)} + lf_{(t)}}{2}\right) / pv_{Fpivot} \tag{1}$$

$$S_{Bratio(t)} = \left(\frac{rb_{(t)} + lb_{(t)}}{2}\right) / pv_{Bpivot} \tag{2}$$

where, $Pv_{Bpivot} = \max(rf_{(t)}, lf_{(t)})$ $Pv_{Fpivot} = \max(rb_{(t)}, lb_{(t)})$ The second processor 60*b* determines whether the traveling that is being determined is straight traveling or not, based on the degree of straight traveling $S_{Bratio}(t)$, the degree of straight traveling $S_{Fratio}(t)$. For example, if the degree of straight traveling $S_{Bratio}(t)$ or the degree of straight traveling $S_{Fratio}(t)$ is greater than 1.0 and is a very large value, the second processor 60*b* determines that the working machine 1 (the machine body 2) is traveling straight. If the degree of straight traveling $S_{Bratio}(t)$ or the degree of straight traveling $S_{Fratio}(t)$ is less than 1.0 and is infinitely close to zero, the second processor 60*b* determines that the working machine 1 (the machine body 2) is making a pivot turn.

For easier description, the degree of straight traveling $S_{Bratio}(t)$ and the degree of straight traveling $S_{Fratio}(t)$ will be hereinafter simply referred to as "degree of straight traveling SV".

Figure 4:
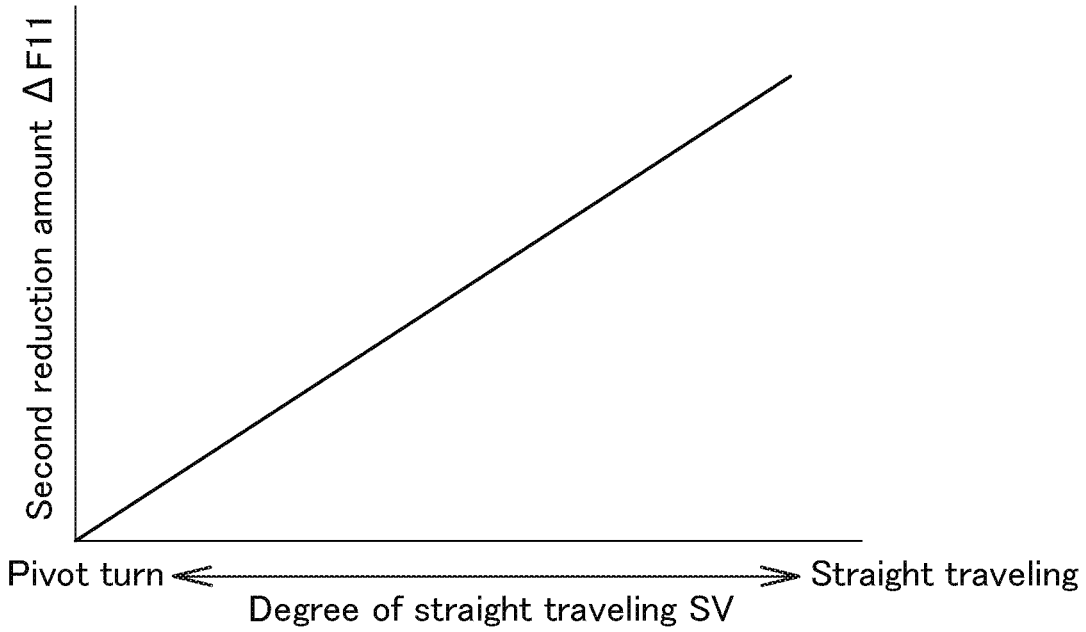
FIG. 4 is a diagram illustrating a relationship between a degree of straight traveling and a second reduction amount.

As illustrated in FIG. 4, based on the degree of straight traveling SV, the second processor 60*b* computes a second amount of reduction ΔF11 in the number of revolutions of the prime mover 32 in shift shock reduction control at the time of shift-down operation. For example, the second processor 60*b* performs the computation such that the second reduction amount ΔF11 increases as the degree of straight traveling SV increases and such that the second reduction amount ΔF11 decreases as the degree of straight traveling SV decreases. In other words, the second processor 60*b* performs the computation such that the second reduction amount ΔF11 will be larger as the degree of straight traveling SV is higher and the state is closer to straight traveling, and such that the second reduction amount ΔF11 will be smaller as the degree of straight traveling SV is lower and the state is closer to a pivot turn.

Figure 5:
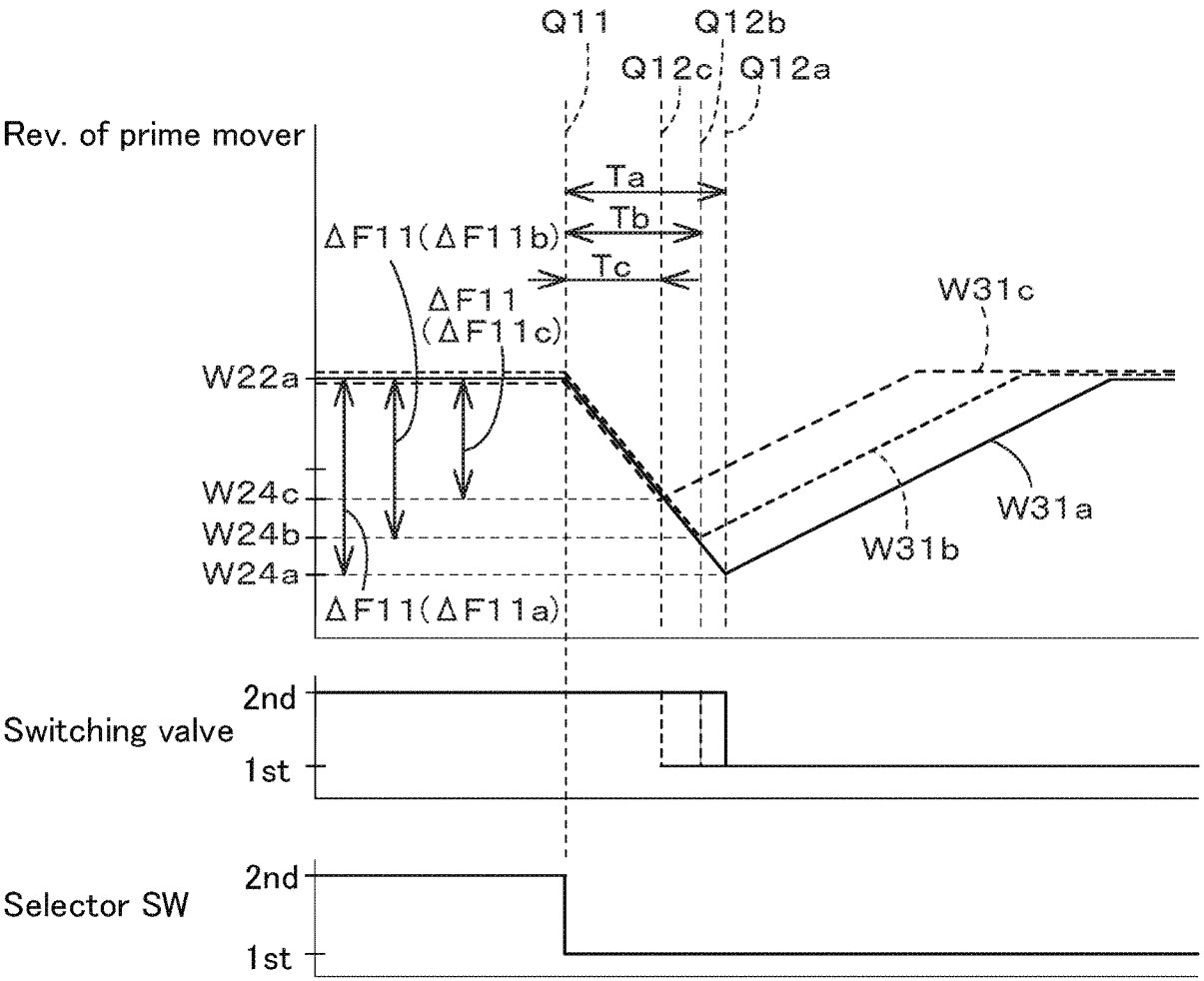
FIG. 5 is a diagram illustrating a relationship between the number of revolutions of a prime mover and the switching of a traveling motor in a case where the speed of the traveling motor is decreased.

FIG. 5 is a diagram illustrating a relationship between reduced values W24a, W24b, and W24c of the number of revolutions of the prime mover 32 and the switching of the traveling motor in a case where shift shock reduction control at the time of shift-down operation is performed.

Let us assume that, at the point in time Q11, the selector switch (SW) 61 is operated, and the controller 60 acquires a shift-down command (a command to shift to "first"). When the controller 60 receives the shift-down command (the command to shift to "first"), the second processor 60*b* computes the degree of straight traveling SV, and computes the second reduction amount ΔF11 based on the computed degree of straight traveling SV.

As illustrated in FIG. 5, for example, the second processor 60*b* computes the second reduction amount to be ΔF11a when the degree of straight traveling SV is high and the state is close to straight traveling at the point in time Q11. Alternatively, the second processor 60*b* computes the second reduction amount to be ΔF11b when the degree of straight traveling SV is lower than in a case of straight traveling and the state is somewhat closer to a pivot turn at the point in time Q11. Alternatively, the second processor 60*b* computes the second reduction amount to be ΔF11c when the degree of straight traveling SV is very low and the state is close to a pivot turn at the point in time Q11.

In this way, depending on the degree of straight traveling SV at the point in time Q11, the second processor 60*b* computes the second reduction amount ΔF11 (ΔF11a, ΔF11b, ΔF11c) (S13).

Figure 2:
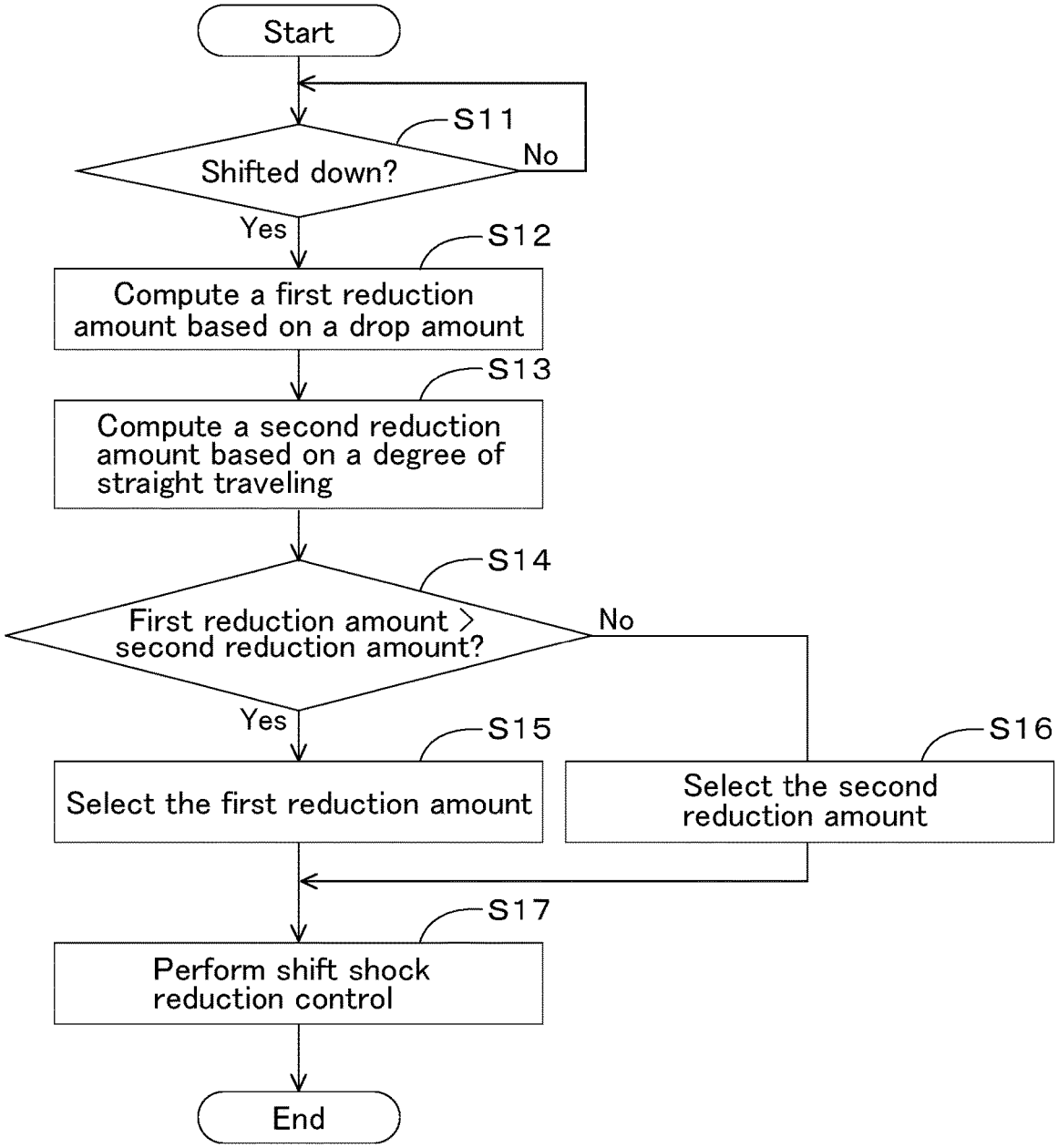
FIG. 2 is a flowchart illustrating shift shock reduction control according to the first embodiment.

Though S13 is executed after S12 in FIG. 2, the scope of the present disclosure is not limited to this example. For example, S12 may be executed after S13, or S12 and S13 may be executed simultaneously.

Reduction Controller 60*c*

Referring back to FIG. 2, the reduction controller 60*c* determines whether or not the absolute value of the first reduction amount ΔF1 computed by the first processor 60*a* is larger than the absolute value of the second reduction amount ΔF11 computed by the second processor 60*b* (S14).

The reduction controller 60*c* selects the first reduction amount ΔF1 (S15) when the absolute value of the first reduction amount ΔF1 is larger than the absolute value of the second reduction amount ΔF11 (S14: YES). The reduction controller 60*c* selects the second reduction amount ΔF11 (S16) when the absolute value of the first reduction amount ΔF1 is smaller than the absolute value of the second reduction amount ΔF11 (S14: NO).

The reduction controller 60*c* performs shift shock reduction control of reducing an amount of hydraulic fluid supply from the traveling pumps 53 to the traveling motors 36 by reducing the number of revolutions of the prime mover 32 based on the first reduction amount ΔF1 or the second reduction amount ΔF11, whichever is larger in absolute value (S17).

For example, when the first reduction amount ΔF1 is selected (S15), the reduction controller 60*c* performs shift shock reduction control of reducing an amount of hydraulic fluid supply from the traveling pumps 53 to the traveling motors 36 by reducing the number of revolutions of the prime mover 32 using the first reduction amount ΔF1 as illustrated in FIG. 3 (S17).

When the first reduction amount ΔF1 illustrated in FIG. 3 is selected, the reduction controller 60*c* of the controller 60 (hereinafter may be just referred to as "controller 60") sets, as a reduced value W14a, W14b, W14c of the number of revolutions of the prime mover in shift shock reduction control, a value obtained by subtracting the first reduction amount ΔF1 (ΔF1a, ΔF1b, ΔF1c) from the actual number of revolutions W12a, W12b, W12c. For example, when the drop amount is ΔD1a in S12, the controller 60 sets a value obtained by subtracting the first reduction amount ΔF1a from the actual number of revolutions W12a as the reduced value W14a. When the drop amount is ΔD1b in S12, the controller 60 sets a value obtained by subtracting the first reduction amount ΔF1b from the actual number of revolutions W12b as the reduced value W14b. When the drop amount is ΔD1c in S12, the controller 60 sets a value obtained by subtracting the first reduction amount ΔF1c from the actual number of revolutions W12c as the reduced value W14c.

Upon completing the setting of the reduced value W14a, W14b, W14c, the controller 60 decreases the actual number of revolutions of the prime mover until reaching the reduced value W14a, W14b, W14c.

Specifically, when the drop amount is ΔD1a, at the point in time Q11, the controller 60 starts decreasing the actual number of revolutions of the prime mover toward the reduced value W14a as indicated by a line W11a. At a point in time Q12a, the revolution value reaches the reduced value W14a as indicated by the line W11a. Upon reaching the reduced value W14a, the controller 60 outputs a signal for solenoid de-energization of the traveling switching valve 34, thereby switching the traveling switching valve 34 (switching valve) from the second state (second speed) to the first state (first speed). After the point in time Q12a, the controller 60 causes the revolution value to return toward the actual number of revolutions before reduction W12a as indicated by the line W11a.

Alternatively, when the drop amount is ΔD1b, at the point in time Q11, the controller 60 starts decreasing the actual number of revolutions of the prime mover toward the reduced value W14b as indicated by a line W11b. At a point in time Q12b, the revolution value reaches the reduced value W14b as indicated by the line W11b. Upon reaching the reduced value W14b, the controller 60 outputs a signal for solenoid de-energization of the traveling switching valve 34, thereby switching the traveling switching valve 34 (switching valve) from the second state (second speed) to the first state (first speed). After the point in time Q12b, the controller 60 causes the revolution value to return toward the actual number of revolutions before reduction W12b as indicated by the line W11b.

Alternatively, when the drop amount is ΔD1c, at the point in time Q11, the controller 60 starts decreasing the actual number of revolutions of the prime mover toward the reduced value W14c as indicated by a line W11c. At a point in time Q12c, the revolution value reaches the reduced value W14c as indicated by the line W11c. Upon reaching the reduced value W14c, the controller 60 outputs a signal for solenoid de-energization of the traveling switching valve 34, thereby switching the traveling switching valve 34 (switching valve) from the second state (second speed) to the first state (first speed). After the point in time Q12c, the controller 60 causes the revolution value to return toward the actual number of revolutions before reduction W12c as indicated by the line W11c.

Let us focus on reduction intervals Ta, Tb, and Tc, which are from the point in time Q11, at which the decreasing of the actual number of revolutions of the prime mover starts, to the points in time Q12a, Q12b, and Q12c, at which the decreasing of the actual number of revolutions of the prime mover ends respectively, namely, at which the actual number of revolutions of the prime mover reaches the reduced value W14a, W14b, W14c respectively. Focusing on the reduction intervals Ta, Tb, and Tc reveals that the controller 60 sets a first rate of reduction in the actual number of revolutions of the prime mover to be constant. That is, the controller 60 sets a constant inclination for the lines W11a, W11b, and W11c in the reduction intervals Ta, Tb, and Tc.

In addition, as can be seen from the fact that the traveling switching valve 34 switches between the second state and the first state at the point in time Q12a, Q12b, Q12c, the controller 60 sets the timing of the switching of the traveling switching valve 34 between the second state and the first state to be different depending on the drop amount ΔD1.

In the first embodiment described above, in each of the reduction intervals Ta, Tb, and Tc, the controller 60 sets the rate of reduction in the actual number of revolutions of the prime mover to be constant throughout the reduction interval Ta, Tb, Tc from the starting point to the ending point. However, the reduction rate may be changed somewhere between the starting point and the ending point.

Figure 6:
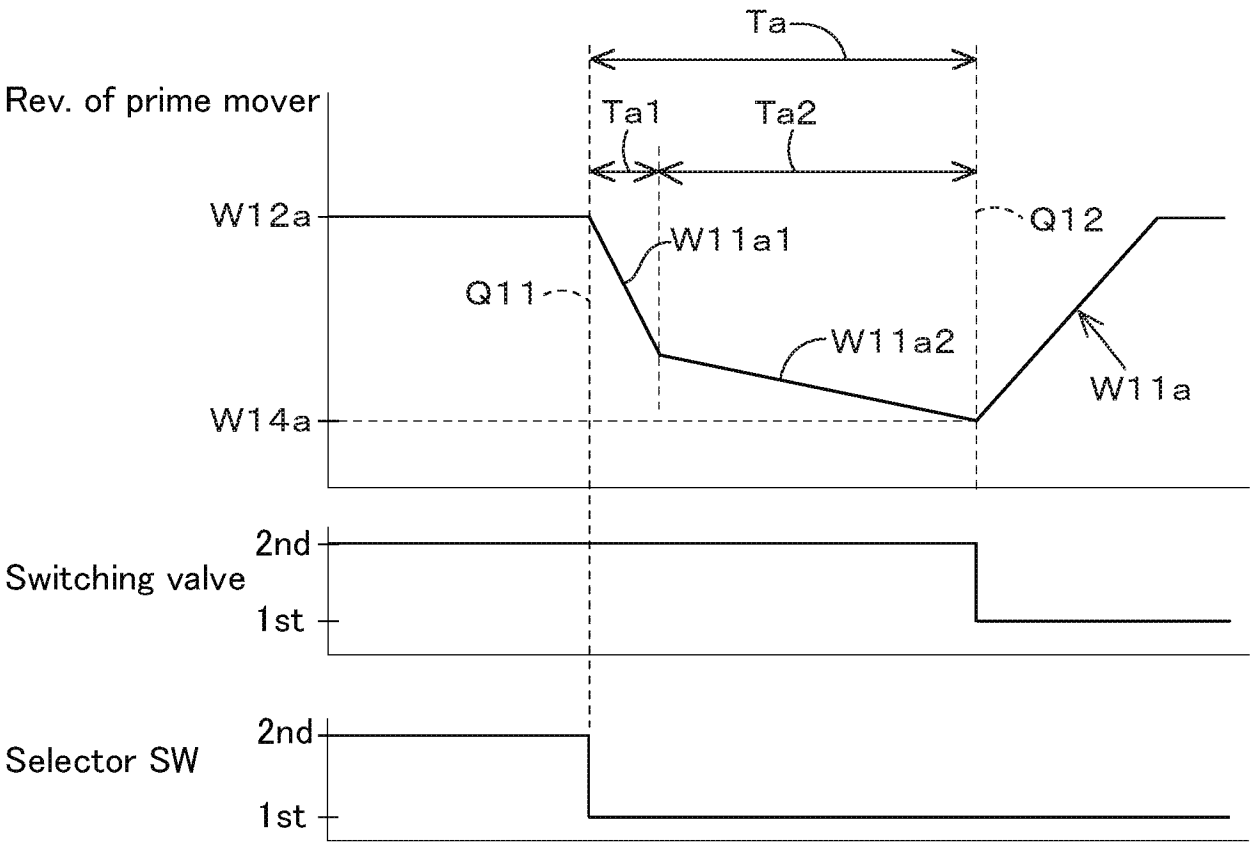
FIG. 6 is a diagram illustrating a relationship between the number of revolutions of a prime mover and the switching of a traveling motor in a case where the speed of the traveling motor is decreased.

FIG. 6 illustrates a modification example in which, in the reduction interval Ta, the rate of reduction in the actual number of revolutions of the prime mover is changed somewhere between the starting point and the ending point.

The controller 60 acquires a shift-down command (a command to shift to "first"), and computes the reduced value W14a based on the drop amount ΔD1; then, as illustrated in FIG. 6, the controller 60 sets the rate of reduction in the actual number of revolutions of the prime mover in an interval (first interval) Ta1, which is from the starting point of the reduction interval Ta to some midpoint therein, to be a second reduction rate, and sets the rate of reduction in the actual number of revolutions of the prime mover in an interval (second interval) Ta2, which is from said some midpoint to the ending point of the reduction interval Ta, to be a third reduction rate. That is, on a line W11a expressing the actual number of revolutions of the prime mover in the reduction interval Ta, the controller 60 sets the second reduction rate in the first interval Ta1 by means of the inclination of a line W11a1 and sets the third reduction rate in the second interval Ta2 by means of the inclination of a line W11a2. The controller 60 sets the second reduction rate (the inclination of the line W11a1) to be higher (steeper) than the third reduction rate (the inclination of the line W11a2).

Though the line W11a is described in this modification example, the second reduction rate and the third reduction rate may be set for the other lines W11b and W11c in the same manner as done for the line W11a. In this case, the above description should be read while replacing the drop amount ΔD1a with the drop amount ΔD1b, ΔD1c, the reduced value W14a with the reduced value W14b, W14c, replacing the reduction interval Ta with the reduction interval Tb, Tc, replacing the line W11a with the line W11b, W11c, replacing the line W11a1 with a line W11b1, W11c1, replacing the line W11a2 with a line W11b2, W11c2, replacing the first interval Ta1 with a first interval Tb1, Tc1, and replacing the second interval Ta2 with a second interval Tb2, Tc2.

Referring back to FIG. 2, when the second reduction amount ΔF11 is selected (S16), the reduction controller 60*c* performs shift shock reduction control of reducing an amount of hydraulic fluid supply from the traveling pumps 53 to the traveling motors 36 by reducing the number of revolutions of the prime mover 32 using the second reduction amount ΔF11 (S17).

When the second reduction amount ΔF11 illustrated in FIG. 5 is selected, the controller 60 (the reduction controller 60*c*) sets, as a reduced value W24a, W24b, W24c in shift shock reduction control, a value obtained by subtracting the second reduction amount ΔF11 (ΔF11a, ΔF11b, ΔF11c) from an actual number of revolutions W22a at the point in time Q11. For example, the controller 60 sets a value obtained by subtracting the second reduction amount ΔF11a from the actual number of revolutions W22a as the reduced value W24a. Alternatively, the controller 60 sets a value obtained by subtracting the second reduction amount ΔF11b from the actual number of revolutions W22a as the reduced value W24b. Alternatively, the controller 60 sets a value obtained by subtracting the second reduction amount ΔF11c from the actual number of revolutions W22a as the reduced value W24c. The actual number of revolutions W22a illustrated in FIG. 5 agrees with any one of the actual number of revolutions W12a, W12b, W12c illustrated in FIG. 3. For example, when the actual number of revolutions at the point in time Q11 illustrated in FIG. 3 is W12a, the actual number of revolutions W22a at the point in time Q11 illustrated in FIG. 5 agrees with the actual number of revolutions W12a.

As illustrated in FIG. 5, upon completing the setting of the reduced value W24a, W24b, W24c, the controller 60 decreases the number of revolutions of the prime mover 32 until reaching the reduced value W24a, W24b, W24c.

Specifically, at the point in time Q11, when the traveling of the machine body 2 is close to straight traveling, the controller 60 starts decreasing the number of revolutions of the prime mover 32 toward the reduced value W24a as indicated by a line W31a. At a point in time Q12a, the revolution value reaches the reduced value W24a as indicated by the line W31a. Upon reaching the reduced value W24a, the controller 60 outputs a signal for solenoid energization of the traveling switching valve 34, thereby switching the traveling switching valve 34 (switching valve) from the second state (second speed) to the first state (first speed). After the point in time Q12a, the controller 60 causes the revolution value to return toward the actual number of revolutions W22a before reduction as indicated by the line W31a.

Alternatively, at the point in time Q11, when the traveling of the machine body 2 is somewhat closer to a pivot turn than straight traveling, the controller 60 starts decreasing the number of revolutions of the prime mover 32 toward the reduced value W24b as indicated by a line W31b. At a point in time Q12b, the revolution value reaches the reduced value W24b as indicated by the line W31b. Upon reaching the reduced value W24b, the controller 60 outputs a signal for solenoid energization of the traveling switching valve 34, thereby switching the traveling switching valve 34 (switching valve) from the second state (second speed) to the first state (first speed). After the point in time Q12b, the controller 60 causes the revolution value to return toward the actual number of revolutions W22a before reduction as indicated by the line W31b.

Alternatively, at the point in time Q11, when the traveling of the machine body 2 is close to a pivot turn, the controller 60 starts decreasing the number of revolutions of the prime mover 32 toward the reduced value W24c as indicated by a line W31c. At a point in time Q12c, the revolution value reaches the reduced value W24c as indicated by the line W31c. Upon reaching the reduced value W24c, the controller 60 outputs a signal for solenoid energization of the traveling switching valve 34, thereby switching the traveling switching valve 34 (switching valve) from the second state (second speed) to the first state (first speed). After the point in time Q12c, the controller 60 causes the revolution value to return toward the actual number of revolutions W22a before reduction as indicated by the line W31c.

Let us focus on reduction intervals Ta, Tb, and Tc, which are from the point in time Q11, at which the decreasing of the number of revolutions of the prime mover 32 starts, to the points in time Q12a, Q12b, and Q12c, at which the decreasing of the number of revolutions of the prime mover 32 ends respectively, namely, at which the number of revolutions of the prime mover 32 reaches the reduced value W24a, W24b, W24c respectively. Focusing on the reduction intervals Ta, Tb, and Tc reveals that the controller 60 sets a first rate of reduction in the number of revolutions of the prime mover 32 to be constant. That is, the controller 60 sets a constant inclination for the lines W31a, W31b, and W31c in the reduction intervals Ta, Tb, and Tc.

In addition, as can be seen from the fact that the traveling switching valve 34 switches between the second state and the first state at the point in time Q12a, Q12b, Q12c, the controller 60 sets the timing of the switching of the traveling switching valve 34 from the second state to the first state to be different depending on the degree of straight traveling SV.

In the first embodiment described above, in each of the reduction intervals Ta, Tb, and Tc, the controller 60 sets the rate of reduction in the number of revolutions of the prime mover 32 to be constant throughout the reduction interval Ta, Tb, Tc from the starting point to the ending point. However, the reduction rate may be changed somewhere between the starting point and the ending point.

Figure 7:
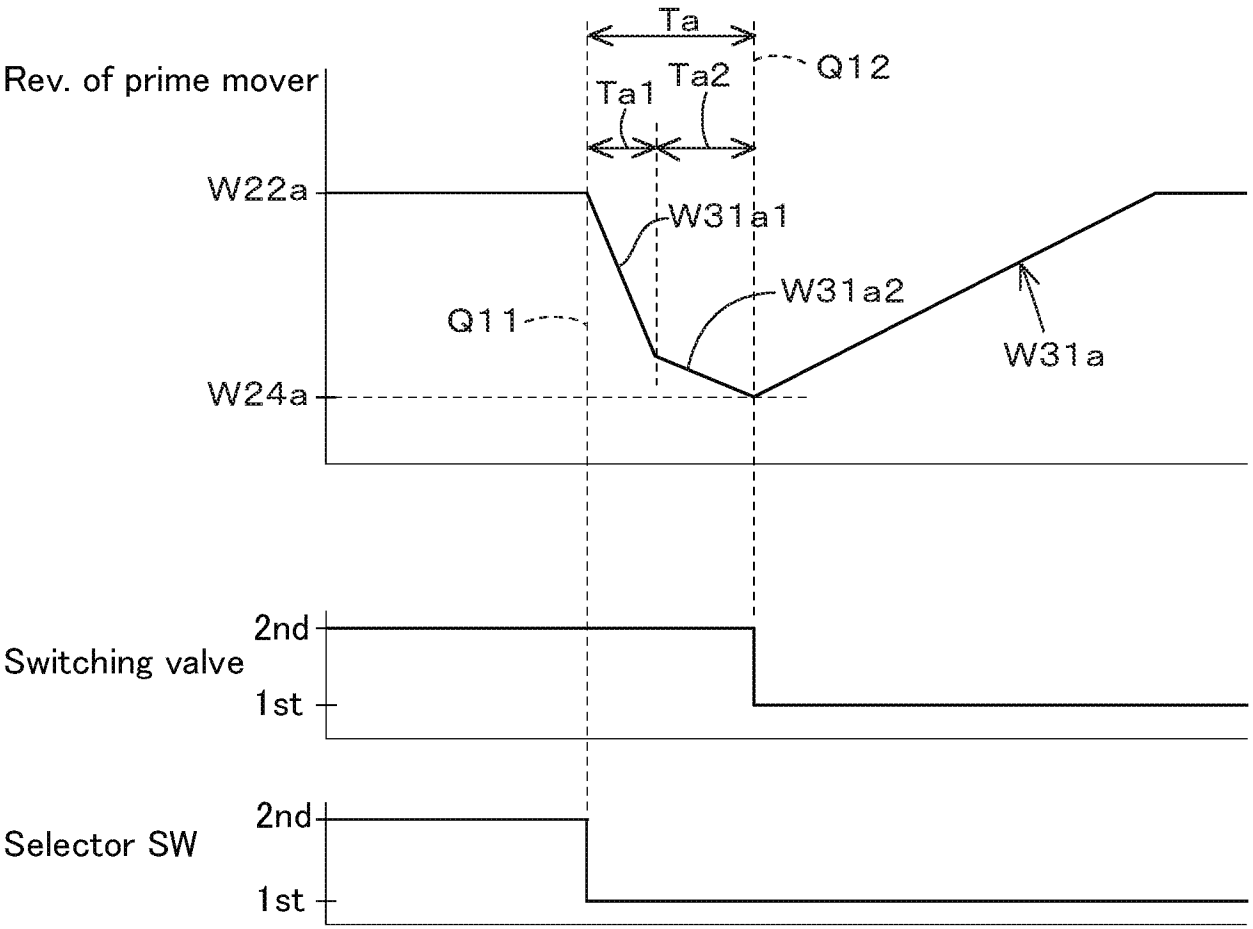
FIG. 7 is a diagram illustrating a relationship between the number of revolutions of a prime mover and the switching of a traveling motor in a case where the speed of the traveling motor is decreased.

FIG. 7 illustrates a modification example in which, in the reduction interval Ta, the rate of reduction in the number of revolutions of the prime mover 32 is changed somewhere between the starting point and the ending point.

The controller 60 acquires a command to shift to "first", and computes the reduced value W24a based on the degree of straight traveling SV; then, as illustrated in FIG. 7, the controller 60 sets the rate of reduction in the number of revolutions of the prime mover 32 in an interval (first interval) Ta1, which is from the starting point of the reduction interval Ta to some midpoint therein, to be a second reduction rate, and sets the rate of reduction in the number of revolutions of the prime mover 32 in an interval (second interval) Ta2, which is from said some midpoint to the ending point of the reduction interval Ta, to be a third reduction rate. That is, on a line W31a expressing the number of revolutions of the prime mover 32 in the reduction interval Ta, the controller 60 sets the second reduction rate in the first interval Ta1 by means of the inclination of a line W31a1 and sets the third reduction rate in the second interval Ta2 by means of the inclination of a line W31a2. The controller 60 sets the second reduction rate (the inclination of the line W31a1) to be higher (steeper) than the third reduction rate (the inclination of the line W31a2).

Though the line W31a is described in this modification example, the second reduction rate and the third reduction rate may be set for the other lines W31b and W31c in the same manner as done for the line W31a. In this case, the above description should be read while replacing the reduced value W24a with the reduced value W24b, W24c, replacing the reduction interval Ta with the reduction interval Tb, Tc, replacing the line W31a with the line W31b, W31c, replacing the line W31a1 with a line W31b1, W31c1, replacing the line W31a2 with a line W31b2, W31c2, replacing the first interval Ta1 with a first interval Tb1, Tc1, and replacing the second interval Ta2 with a second interval Tb2, Tc2.

The working machine 1 according to the first embodiment described above includes: the prime mover 32; the traveling pumps 53 configured to operate by power of the prime mover 32 and deliver a hydraulic fluid; the traveling motors 36 capable of rotating using the hydraulic fluid delivered by the traveling pumps 53; the machine body 2 in which the prime mover 32, the traveling pumps 53, and the traveling motors 36 are provided; the traveling switching valve 34 switchable between a first state, in which rotation speeds of the traveling motors 36 are able to be increased up to a first maximum or utmost speed, and a second state, in which the rotation speeds of the traveling motors 36 are able to be increased up to a second maximum or utmost speed higher than the first maximum or utmost speed; the traveling manipulator 54 including the operation valves 55 capable of changing hydraulic fluid pressure acting on the traveling pumps 53 in response to operation of the operation member 59; and the controller 60 configured or programmed to perform shift shock reduction control of reducing an amount of hydraulic fluid supply from the traveling pumps 53 to the traveling motors 36 when shift-down switching from the second state to the first state is performed. The controller 60 includes: the first processor 60*a* configured or programmed to, based on a drop amount ΔD1 that is a difference between a target number of revolutions of the prime mover 32 and an actual number of revolutions of the prime mover 32, compute a first reduction amount ΔF1 for reducing the amount of hydraulic fluid supply from the traveling pumps 53 to the traveling motors 36 in the shift shock reduction control; the second processor 60*b* configured or programmed to, based on a degree of straight traveling of the machine body 2, compute a second reduction amount ΔF11 for reducing the amount of hydraulic fluid supply from the traveling pumps 53 to the traveling motors 36 in the shift shock reduction control; and the reduction controller 60*c* configured or programmed to, based on the first reduction amount ΔF1 computed by the first processor 60*a* or the second reduction amount ΔF11 computed by the second processor 60*b*, whichever is larger in absolute value, perform the shift shock reduction control.

With this configuration, since the first processor 60*a* computes the first reduction amount ΔF1 based on the drop amount ΔD1 that is the difference between the target number of revolutions of the prime mover 32 and the actual number of revolutions of the prime mover 32, it is possible to compute a shift shock reduction amount according to a load state of the machine body 2. Moreover, since the second processor 60*b* computes the second reduction amount ΔF11 based on the degree of straight traveling of the machine body 2, it is possible to compute a shift shock reduction amount according to a traveling state of the machine body 2. Then, based on the first reduction amount ΔF1 or the second reduction amount ΔF11, whichever is larger in absolute value, the reduction controller 60*c* performs shift shock reduction control. Therefore, when shift-down switching from the second state to the first state is performed, it is possible to select the degree of straight traveling or the drop amount, whichever produces greater shock reduction effects, thereby realizing effective shift shock reduction control at the time of shift-down operation.

When the first reduction amount ΔF1 is selected by the reduction controller 60*c*, the controller 60 sets, as a reduced value of the number of revolutions of the prime mover 32 in shift shock reduction control, a value obtained by subtracting the first reduction amount ΔF1 from the actual number of revolutions of the prime mover 32. With this configuration, even in a case where the actual number of revolutions of the prime mover 32 drops due to a load, it is possible to set the actual number of revolutions of the prime mover 32 at the time of shift-down operation appropriately.

In the reduction interval Ta, Tb, Tc till the actual number of revolutions of the prime mover 32 reaching the reduced value, the controller 60 sets the first rate of reduction in the actual number of revolutions of the prime mover 32 to be constant from the starting point to the ending point of the reduction interval Ta, Tb, Tc. With this configuration, it is possible to reduce the output of the first, second traveling pump 53L, 53R smoothly in stages. Therefore, it is possible to reduce a shift shock more efficiently.

In the reduction interval Ta, Tb, Tc till the actual number of revolutions of the prime mover 32 reaching the reduced value, the controller 60 sets the second rate of reduction in the actual number of revolutions of the prime mover 32 in an interval from the starting point of the reduction interval Ta, Tb, Tc to some midpoint therein to be higher than the third rate of reduction in the actual number of revolutions of the prime mover 32 in an interval from said some midpoint to the ending point of the reduction interval Ta, Tb, Tc. With this configuration, it is possible to enhance responsiveness of the first, second traveling pump 53L, 53R in shift shock reduction control.

The controller 60 varies the timing of switching the traveling switching valve 34 from the second state to the first state according to the drop amount ΔD1. With this configuration, it is possible to vary the timing of shift-down switching according to the load of the prime mover 32, resulting in enhanced work operability.

The working machine 1 includes the selector switch 61 configured to issue a shift command for either shift-up switching or shift-down switching; and the accelerator 65 configured to set a target number of revolutions of the prime mover 32. When commanded from the selector switch 61, the controller 60 reduces the actual number of revolutions of the prime mover 32 toward a reduced value set based on the first reduction amount ΔF1 and switches the traveling switching valve 34 to either the first state or the second state in accordance with the shift command. With this configuration, it is possible to perform shifting after sufficiently reducing the actual number of revolutions of the prime mover 32, resulting in improved shift shock reduction.

The controller 60 sets the first reduction amount ΔF1 to be large when the drop amount ΔD1 is small and sets the first reduction amount ΔF1 to be small when the drop amount ΔD1 is large. With this configuration, it is possible to achieve a greater shift shock reduction in a case where the load on the prime mover 32 is light and thus where there is a margin in the output of the prime mover 32, and, on the other hand, in a case where the load on the prime mover 32 is heavy and thus where the margin in the output of the prime mover 32 is not enough, it is possible to reduce a shift shock and make the returning of the actual number of revolutions of the prime mover 32 after reducing the shift shock (after shifting) faster by making the shift shock reduction moderate.

Second Embodiment

In the first embodiment described above, the first processor 60*a* computes the first amount of reduction ΔF1 in the number of revolutions of the prime mover 32 based on the drop amount ΔD1, the second processor 60*b* computes the second amount of reduction ΔF11 in the number of revolutions of the prime mover 32 based on the degree of straight traveling of the machine body 2, and the reduction controller 60*c* performs shift shock reduction control based on the first reduction amount ΔF1 or the second reduction amount ΔF11, whichever is larger in absolute value. However, the scope of the present disclosure is not limited to this example. In the working machine 1 according to a second embodiment, the first processor 60*a* computes a first amount of reduction ΔF2 in opening of the actuation valve 69 based on the drop amount ΔD1, the second processor 60*b* computes a second amount of reduction ΔF21 in opening of the actuation valve 69 based on the degree of straight traveling of the machine body 2, and the reduction controller 60*c* performs shift shock reduction control based on the first reduction amount ΔF2 or the second reduction amount ΔF21, whichever is larger in absolute value.

That is, the second embodiment is different from the first embodiment in that the opening of the actuation valve 69 is reduced instead of reducing the number of revolutions of the prime mover 32, which has been disclosed in the first embodiment. Therefore, in the second embodiment, the point of difference from the first embodiment will be described in detail.

When the traveling switching valve 34 is switched from the second state (second speed) to the first state (first speed), that is, when the rotation speed of the traveling motor is decreased from the second speed to the first speed, the controller 60 performs shift shock reduction control that involves reducing the opening of the actuation valve 69.

As illustrated in FIG. 1, in shift shock reduction control, the controller 60 reduces a shift shock by controlling the opening of the actuation valve 69. The actuation valve 69 is connected on the "after-branching" delivery fluid passage 40 in an interval 40*a* leading to the traveling manipulator 54, namely, upstream of the operation valves 55. The actuation valve 69 may be connected on the traveling fluid passage 45 downstream of the operation valves 55.

The actuation valve 69 is a proportional solenoid valve (proportional valve). Its opening can be changed by means of a control signal outputted from the controller 60. The control signal is, for example, a voltage or a current, etc. The actuation valve 69 is a valve whose opening increases as the control signal (voltage, current) outputted from the controller 60 increases and whose opening decreases as the control signal (voltage, current) outputted from the controller 60 decreases.

That is, in the shift shock reduction control, the controller 60 reduces the opening of the actuation valve 69 by changing the level of the control signal outputted to the actuation valve 69.

First Arithmetic Operator 60*a*

In the second embodiment, in S12 of FIG. 2, the first processor 60*a* computes the first amount of reduction ΔF2 in opening of the actuation valve 69 instead of the first amount of reduction ΔF1 in the number of revolutions of the prime mover 32. More specifically, when the controller 60 receives a shift-down command (a command to shift to "first"), based on the drop amount ΔD1 that is the difference between the target number of revolutions of the prime mover 32 and the actual number of revolutions of the prime mover 32, the first processor 60*a* computes the first amount of reduction ΔF2 in opening of the actuation valve 69 in shift shock reduction control (S12).

The first processor 60*a* computes the first amount of reduction ΔF2 in opening of the actuation valve 69 corresponding to the drop amount ΔD1 illustrated in FIG. 3. For example, the first processor 60*a* computes the first amount of reduction ΔF2 in opening of the actuation valve 69 whose value decreases as the drop amount ΔD1 increases. That is, in the computation of the first amount of reduction ΔF2 in opening of the actuation valve 69, the first processor 60*a* outputs a large value of the first reduction amount ΔF2 when the drop amount ΔD1 is small, and outputs a small value of the first reduction amount ΔF2 when the drop amount ΔD1 is large. The first processor 60*a* may have a data table TB in which the drop amount ΔD1 is pre-stored in association with the first amount of reduction ΔF2 in opening of the actuation valve 69 (see FIG. 8), and may compute the first amount of reduction ΔF2 in opening of the actuation valve 69 corresponding to the drop amount ΔD1 by using the data table TB. Alternatively, the first processor 60*a* may have a memory table in which, as the first amount of reduction ΔF2 in opening of the actuation valve 69, the difference between the opening of the actuation valve 69 at the point in time Q11 illustrated in FIG. 3 and the opening of the actuation valve 69 when the number of revolutions of the prime mover 32 is reduced by the first amount of reduction ΔF1 based on the drop amount ΔD1 is pre-stored in association with the drop amount ΔD1, and may compute the first amount of reduction ΔF2 in opening of the actuation valve 69 corresponding to the drop amount ΔD1 by using this memory table.

Second Arithmetic Operator 60*b*

In the second embodiment, in S13 of FIG. 2, the second processor 60*b* computes the second amount of reduction ΔF21 in opening of the actuation valve 69 instead of the second amount of reduction ΔF11 in the number of revolutions of the prime mover 32. More specifically, when the controller 60 receives a shift-down command (a command to shift to "first"), based on the degree of straight traveling SV of the machine body 2, the second processor 60*b* computes the second amount of reduction ΔF21 in opening of the actuation valve 69 in shift shock reduction control (S13).

For example, as illustrated in FIG. 4, the second processor 60*b* performs the computation such that the second amount of reduction in opening of the actuation valve 69 (the second reduction amount ΔF21 in FIG. 9) increases as the degree of straight traveling SV increases and such that the second amount of reduction in opening of the actuation valve 69 (the second reduction amount ΔF21 in FIG. 9) decreases as the degree of straight traveling SV decreases. In other words, the second processor 60*b* performs the computation such that the second reduction amount ΔF21 will be large when the degree of straight traveling SV is high and the state is close to straight traveling, and such that the second reduction amount ΔF21 will be small when the degree of straight traveling SV is low and the state is close to a pivot turn.

Figure 9:
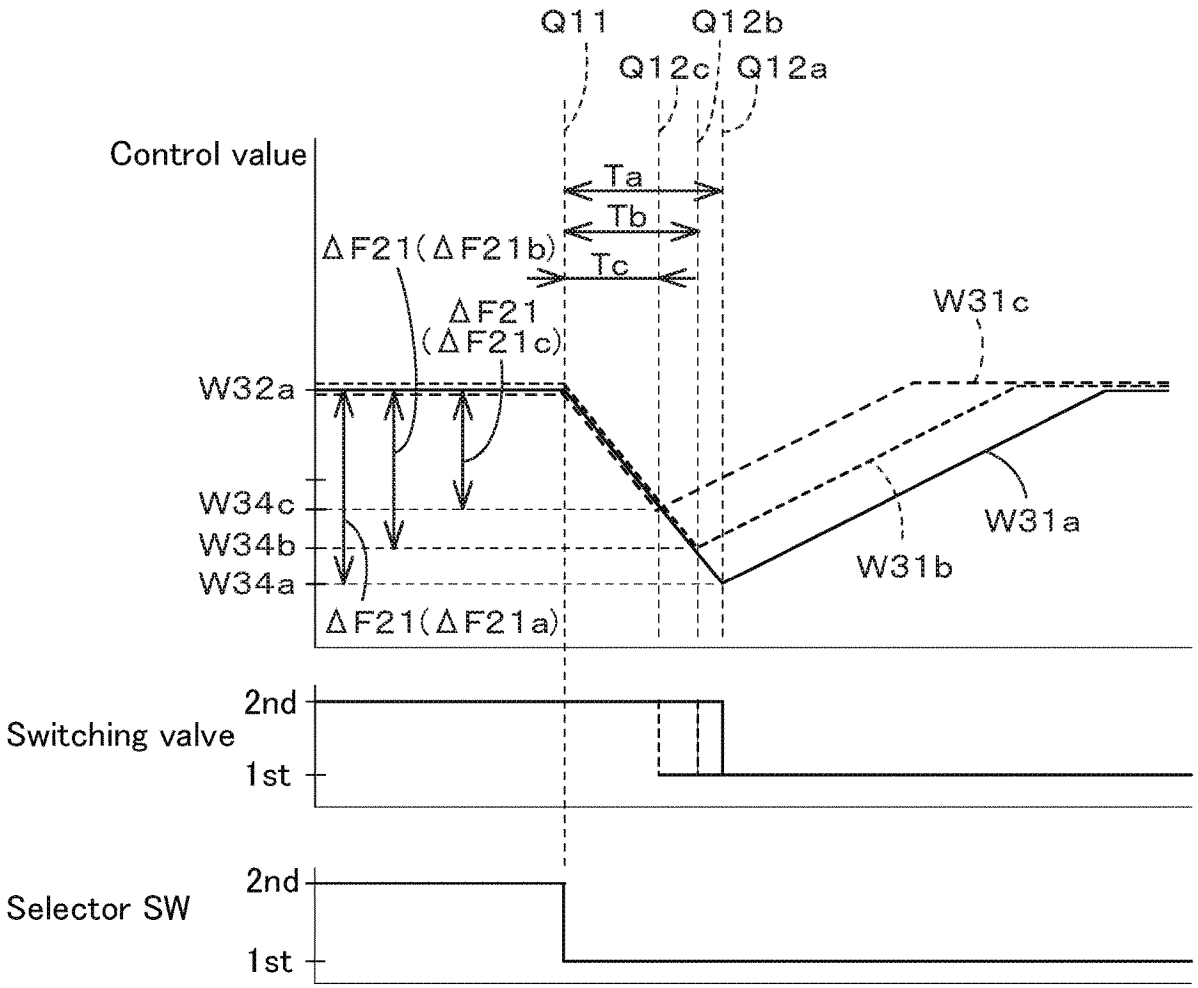
FIG. 9 is a diagram illustrating a relationship between a control value of a control signal outputted to an actuation valve and the switching of a traveling motor in a case where the speed of the traveling motor is decreased according to a second embodiment.

FIG. 9 is a diagram illustrating a relationship between the control value of a control signal outputted to the actuation valve 69 (reduced value W34a, W34b, W34c) and the switching of the traveling motor in a case where shift shock reduction control at the time of shift-down operation is performed.

Let us assume that, at the point in time Q11, the selector switch (SW) 61 is operated, and the controller 60 acquires a shift-down command (a command to shift to "first"). When the controller 60 receives the shift-down command (the command to shift to "first"), the second processor 60*b* computes the degree of straight traveling SV, and computes the second reduction amount ΔF21 based on the computed degree of straight traveling SV.

As illustrated in FIG. 8, for example, the second processor 60*b* computes the second reduction amount to be ΔF21a when the degree of straight traveling SV is high and the state is close to straight traveling at the point in time Q11. Alternatively, the second processor 60*b* computes the second reduction amount to be ΔF21b when the degree of straight traveling SV is lower than in a case of straight traveling and the state is somewhat closer to a pivot turn at the point in time Q11. Alternatively, the second processor 60*b* computes the second reduction amount to be ΔF21c when the degree of straight traveling SV is very low and the state is close to a pivot turn at the point in time Q11.

In this way, depending on the degree of straight traveling SV at the point in time Q11, the second processor 60*b* computes the second reduction amount ΔF21 (ΔF21a, ΔF21b, ΔF21c) (S13).

Reduction Controller 60*c*

The reduction controller 60*c* determines whether or not the absolute value of the first reduction amount ΔF2 computed by the first processor 60*a* is larger than the absolute value of the second reduction amount ΔF21 computed by the second processor 60*b* (S14 in FIG. 2).

The reduction controller 60*c* selects the first reduction amount ΔF2 (S15) when the absolute value of the first reduction amount ΔF2 is larger than the absolute value of the second reduction amount ΔF21 (S14: YES). The reduction controller 60*c* selects the second reduction amount ΔF21 (S16) when the absolute value of the first reduction amount ΔF2 is smaller than the absolute value of the second reduction amount ΔF21 (S14: NO).

The reduction controller 60*c* performs shift shock reduction control of reducing an amount of hydraulic fluid supply from the traveling pumps 53 to the traveling motors 36 by reducing the number of revolutions of the prime mover 32 based on the first reduction amount ΔF2 or the second reduction amount ΔF21, whichever is larger in absolute value (S17).

The working machine 1 according to the second embodiment described above includes: the actuation valve 69 connected to the operation valves 55 upstream of or downstream of the operation valves 55 and capable of controlling a hydraulic fluid flowing to the operation valves 55; wherein the controller 60 performs shift shock reduction control of reducing an amount of hydraulic fluid supply from the traveling pumps 53 to the traveling motors 36 by reducing the opening of the actuation valve 69 by outputting a control signal to the actuation valve 69 when shift-down switching from the second state to the first state is performed; the first processor 60*a* computes the first amount of reduction ΔF2 in opening of the actuation valve 69 in the shift shock reduction control based on the drop amount ΔD1 that is the difference between the target number of revolutions of the prime mover 32 and the actual number of revolutions of the prime mover 32; the second processor 60*b* computes the second amount of reduction ΔF21 in opening of the actuation valve 69 in the shift shock reduction control based on the degree of straight traveling SV of the machine body 2; and the reduction controller 60*c* performs the shift shock reduction control of reducing the amount of hydraulic fluid supply from the traveling pumps 53 to the traveling motors 36 by reducing the opening of the actuation valve 69 based on the first reduction amount ΔF2 computed by the first processor 60*a* or the second reduction amount ΔF21 computed by the second processor 60*b*, whichever is larger in absolute value.

With this configuration, since the first processor 60*a* computes the first amount of reduction ΔF2 in the number of revolutions of the prime mover 32 based on the drop amount ΔD1 that is the difference between the target number of revolutions of the prime mover 32 and the actual number of revolutions of the prime mover 32, it is possible to compute a shift shock reduction amount according to a load state of the machine body 2. Since the second processor 60*b* computes the second amount of reduction ΔF21 in the number of revolutions of the prime mover 32 based on the degree of straight traveling of the machine body 2, it is possible to compute a shift shock reduction amount according to a traveling state of the machine body 2. Then, based on the first reduction amount ΔF2 or the second reduction amount ΔF21, whichever is larger in absolute value, the reduction controller 60*c* performs shift shock reduction control. Therefore, when shift-down switching from the second state to the first state is performed, it is possible to select the degree of straight traveling or the drop amount, whichever produces greater shock reduction effects, thereby realizing effective shift shock reduction control at the time of shift-down operation by reducing the number of revolutions of the prime mover 32 appropriately.

The actuation valve 69 is a valve whose opening increases as the control value corresponding to the control signal increases and whose opening decreases as said control value decreases. Based on the degree of straight traveling SV of the machine body 2, the controller 60 sets the second reduction amount ΔF21 of the control value as an amount of reduction in opening of the actuation valve 69, and computes the reduced value W34a, W34b, W34c in shift shock reduction control based on the second reduction amount ΔF21. With this configuration, it is possible to set the reduced value W34a, W34b, W34c of the control value of the control signal outputted to the actuation valve 69 according to the degree of straight traveling SV of the machine body 2; therefore, it is possible to reduce a shift shock more smoothly.

In the reduction interval Ta, Tb, Tc till the control value reaching the reduced value W34a, W34b, W34c, the controller 60 sets the first rate of reduction in the control value to be constant from the starting point to the ending point of the reduction interval Ta, Tb, Tc. With this configuration, it is possible to reduce hydraulic fluid pressure acting on the first, second traveling pump 53L, 53R smoothly in a quick manner. Therefore, it is possible to reduce a shift shock smoothly without bringing discomfort.

In the reduction interval Ta, Tb, Tc till the control value reaching the reduced value W34a, W34b, W34c, the controller 60 sets the second rate of reduction in the control value in an interval from the starting point of the reduction interval Ta, Tb, Tc to some midpoint therein to be higher than the third rate of reduction in the control value in an interval from said some midpoint to the ending point of the reduction interval Ta, Tb, Tc. With this configuration, it is possible to enhance responsiveness of the actuation valve 69 in shift shock reduction control.

The controller 60 varies the timing of switching the traveling switching valve 34 from the first state to the second state according to the degree of straight traveling SV. With this configuration, it is possible to make the timing of shift-up switching when the machine body 2 is traveling straight different from the timing of shift-up switching when the machine body 2 is making a pivot turn or the like, resulting in enhanced work operability.

The controller 60 sets the second reduction amount ΔF21 to be large when the degree of straight traveling SV is high and sets the second reduction amount ΔF21 to be small when the degree of straight traveling SV is low. With this configuration, for example, it is possible to achieve a greater shift shock reduction at the time of straight-traveling shift-up operation by setting the second reduction amount ΔF21 to be large when the machine body 2 is traveling straight, and it is possible to reduce a shift shock stably while maintaining a difference in hydraulic fluid pressure (differential pressure) acting at the normal rotation side or the reverse rotation side on the first traveling pump 53L and the second traveling pump 53R by setting the second reduction amount ΔF21 to be small when the machine body 2 is switching from straight traveling to a pivot turn or when the machine body 2 is making a pivot turn.

The working machine 1 includes: the traveling device 5 (a first traveling device) provided on the left side of the machine body 2; and the traveling device 5 (a second traveling device) provided on the right side of the machine body 2, wherein the first traveling motor 36L is a first traveling motor configured to transmit power for traveling to the traveling device 5, the second traveling motor 36R is a second traveling motor configured to transmit power for traveling to the traveling device 5, the first traveling pump 53L is capable of causing the first traveling motor to operate, the second traveling pump 53R is capable of causing the second traveling motor to operate, and the traveling switching valve 34 is capable of switching the first traveling motor 36L and the second traveling motor 36R between the first speed and the second speed. With this configuration, it is possible to reduce a shift shock more smoothly in the working machine 1 that includes the traveling device 5 provided on the left side of the machine body 2 and the traveling device 5 provided on the right side of the machine body 2.

Third Embodiment

In the first and second embodiments described above, based on the first reduction amount computed by the first processor 60*a* or the second reduction amount computed by the second processor 60*b*, whichever is larger in absolute value, the reduction controller 60*c* performs shift shock reduction control. However, the scope of the present disclosure is not limited to this example. For example, in a third embodiment, as illustrated in FIG. 10, the reduction controller 60*c* may perform shift shock reduction control based on the first reduction amount computed by the first processor 60*a* or the second reduction amount computed by the second processor 60*b*, whichever is smaller in absolute value (S14A).

The reduction controller 60*c* has a software configuration whose functions are realized by running, by a CPU of the controller 60, a fourth control program for performing shift shock reduction control based on the first reduction amount or the second reduction amount, whichever is smaller in absolute value. The reduction controller 60*c* may have a configuration including a semiconductor such as a CPU or an MPU, an electric/electronic circuit, etc.

Figure 10:
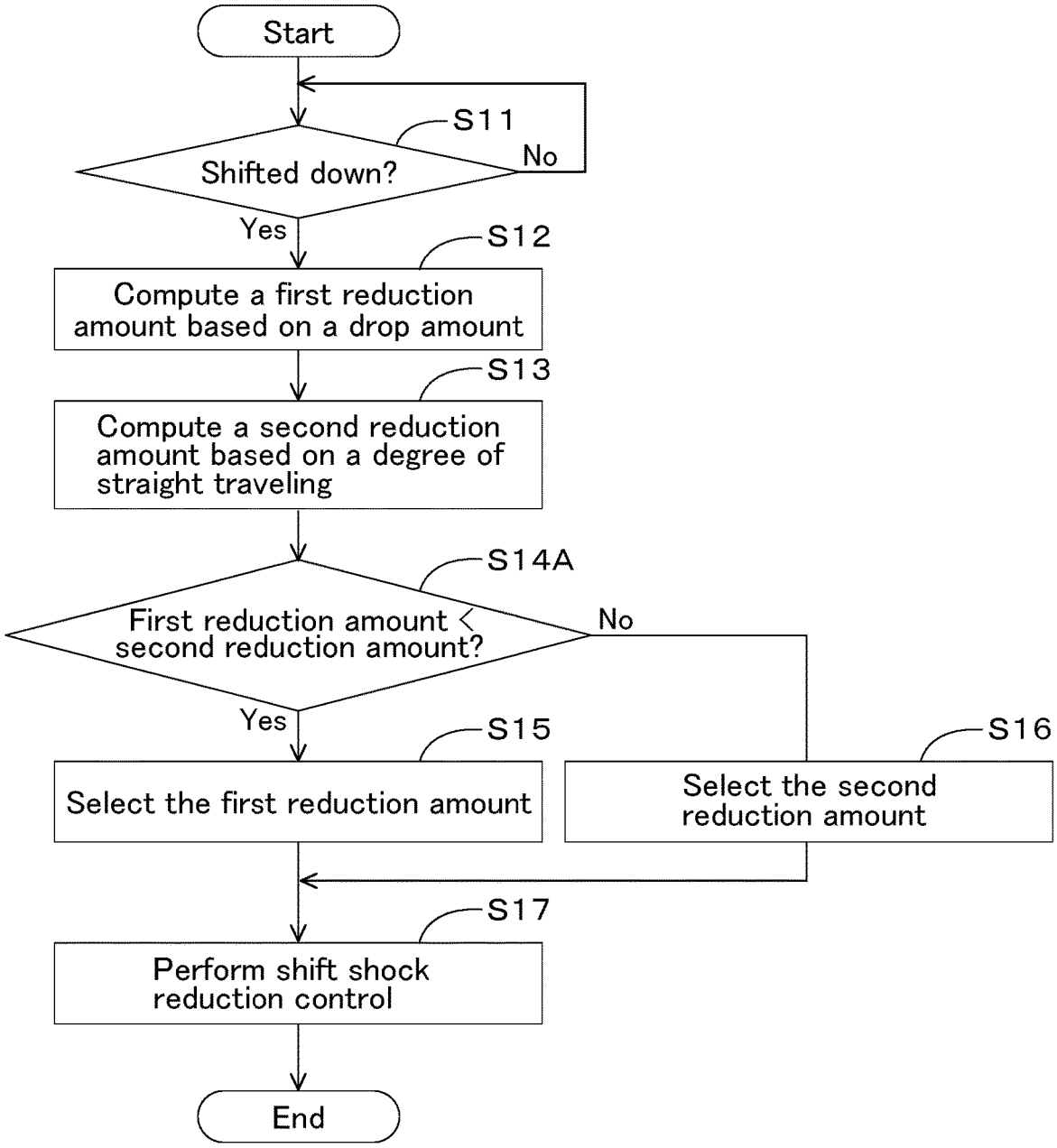
FIG. 10 is a flowchart illustrating shift shock reduction control according to a third embodiment.

For example, as illustrated in FIG. 10, the reduction controller 60*c* performs shift shock reduction control of reducing an amount of hydraulic fluid supply from the traveling pumps 53 to the traveling motors 36 by reducing the number of revolutions of the prime mover 32 based on the first amount of reduction ΔF1 in the number of revolutions of the prime mover 32 computed by the first processor 60*a* (see FIG. 3) or the second amount of reduction ΔF11 in the number of revolutions of the prime mover 32 computed by the second processor 60*b* (see FIG. 5), whichever is smaller in absolute value (S14A).

Alternatively, the reduction controller 60*c* performs shift shock reduction control of reducing an amount of hydraulic fluid supply from the traveling pumps 53 to the traveling motors 36 by reducing the opening of the actuation valve 69 based on the first amount of reduction ΔF2 in opening of the actuation valve 69 computed by the first processor 60*a* (see FIG. 8) or the second amount of reduction ΔF21 in opening of the actuation valve 69 computed by the second processor 60*b* (see FIG. 9), whichever is smaller in absolute value (S14A).

In the working machine 1 according to the third embodiment described above, based on the first reduction amount ΔF1 or the second reduction amount ΔF11, whichever is smaller in absolute value, the reduction controller 60*c* performs shift shock reduction control. Therefore, when shift-down switching from the second state to the first state is performed, it is possible to select the degree of straight traveling or the drop amount, whichever produces less shock reduction effects, thereby realizing optimum shift shock reduction control without wasteful traveling power loss. For example, when the first reduction amount ΔF1 based on the drop amount ΔD1 is used, it could happen that the number of revolutions of the prime mover 32 is reduced more than necessary, resulting in poorer traveling performance. However, the second reduction amount ΔF11 based on the degree of straight traveling of the machine body 2 is in some instances smaller than the first reduction amount ΔF1, and if so, it is possible to avoid such a more-than-necessary reduction in the number of revolutions of the prime mover 32 by selecting the second reduction amount ΔF11.

Fourth Embodiment

In each of the foregoing embodiments, the traveling manipulator 54 is a hydraulic-type device configured to change pilot pressure acting on the traveling pumps (the first traveling pump 53L and the second traveling pump 53R) by means of the operation valves 55. However, the traveling manipulator 54 may be an electric-type device. In a working machine according to a fourth embodiment, the traveling manipulator 54 illustrated in FIG. 11 operates electrically.

Figure 11:
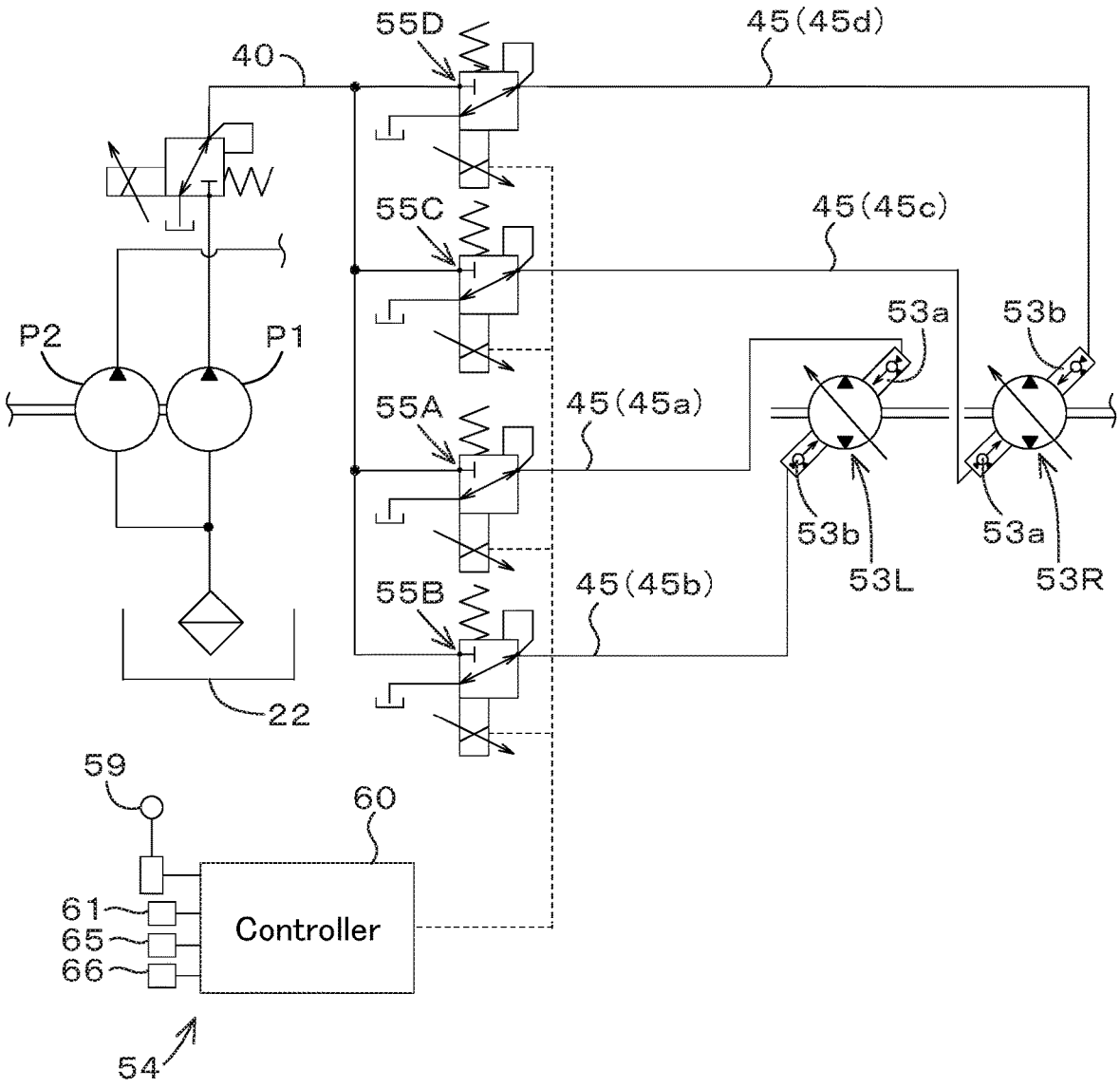
FIG. 11 is a diagram illustrating a modified configuration in which a hydraulic-type manipulator is replaced with an electric-type manipulator such as a joystick.

As illustrated in FIG. 11, the traveling manipulator 54 includes the operation member 59 configured to be swung in the left-right direction (the machine-body width direction) or the front-rear direction selectively and the operation valves 55 (operation valves 55A, 55B, 55C, and 55D) that are proportional solenoid valves. An operation detection sensor configured to detect an operation amount and an operation direction of the operation member 59 is connected to the controller 60. Based on the operation amount and the operation direction detected by the operation detection sensor, the controller 60 controls the operation valves 55 (operation valves 55A, 55B, 55C, and 55D).

When the operation member 59 is operated forward (in the direction indicated by the arrow A1; see FIG. 1), control signals are outputted to the operation valves 55A and 55C to cause the swash plates of the first traveling pump 53L and the second traveling pump 53R to tilt in the normal (forward) direction.

When the operation member 59 is operated rearward (in the direction indicated by the arrow A2; see FIG. 1), control signals are outputted to the operation valves 55B and 55D to cause the swash plates of the first traveling pump 53L and the second traveling pump 53R to tilt in the reverse (rearward) direction.

When the operation member 59 is operated rightward (in the direction indicated by the arrow A3; see FIG. 1), control signals are outputted to the operation valves 55A and 55D to cause the swash plate of the first traveling pump 53L to tilt in the normal direction and cause the swash plate of the second traveling pump 53R to tilt in the reverse direction.

When the operation member 59 is operated leftward (in the direction indicated by the arrow A4; see FIG. 1), control signals are outputted to the operation valves 55B and 55C to cause the swash plate of the first traveling pump 53L to tilt in the reverse direction and cause the swash plate of the second traveling pump 53R to tilt in the normal direction.

The controller 60 (the reduction controller 60*c*) may perform shift shock reduction control of changing the swash-plate angles of the first traveling pump 53L and the second traveling pump 53R by changing the control values of control signals to the operation valves 55A to 55D based on the first reduction amount ΔF1 or the second reduction amount ΔF11, whichever is larger in absolute value, thereby reducing an amount of hydraulic fluid supply from the first traveling pump 53L and the second traveling pump 53R to the first traveling motor 36L and the second traveling motor 36R.

The traveling switching valve 34 may be any valve as long as it is switchable between the first state, in which it sets the rotation speed of the traveling motor (the first, second traveling motor 36L, 36R) to the first speed, and the second state, in which it sets the rotation speed of the traveling motor (the first, second traveling motor 36L, 36R) to the second speed. The traveling switching valve 34 may be a proportional valve different from a direction switching valve.

The traveling motor may be a motor that has "neutral" between the first speed and the second speed.

The traveling motor (the first, second traveling motor 36L, 36R) may be an axial piston motor or a radial piston motor. When the traveling motor is a radial piston motor, it is possible to perform switching to the first speed by an increase in motor displacement, and to the second speed by a decrease in motor displacement.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine, comprising:

a prime mover;

a traveling pump to operate by power of the prime mover and deliver a hydraulic fluid;

a traveling motor to rotate using the hydraulic fluid delivered by the traveling pump;

a machine body in which the prime mover, the traveling pump, and the traveling motor are provided;

a traveling switching valve operable to switch between a first state allowing a rotation speed of the traveling motor to increase up to a first maximum speed, and a second state allowing the rotation speed of the traveling motor to increase up to a second maximum speed higher than the first maximum speed;

a traveling manipulator including an operation valve to change hydraulic fluid pressure acting on the traveling pump in response to operation of an operation member; and a controller configured or programmed to perform shift shock reduction control of reducing an amount of hydraulic fluid supply from the traveling pump to the traveling motor when shift-down switching from the second state to the first state is performed, the controller including a first processor configured or programmed to, based on a drop amount that is a difference between a target number of revolutions of the prime mover and an actual number of revolutions of the prime mover, compute a first reduction amount for reducing the amount of hydraulic fluid supply from the traveling pump to the traveling motor in the shift shock reduction control;

a second processor configured or programmed to, based on a degree of straight traveling of the machine body, compute a second reduction amount for reducing the amount of hydraulic fluid supply from the traveling pump to the traveling motor in the shift shock reduction control; and a reduction controller configured or programmed to, based on a reduction amount that is either the first reduction amount computed by the first processor or the second reduction amount computed by the second processor, whichever is larger in absolute value, perform the shift shock reduction control.

2. The working machine according to claim 1, wherein the first processor is configured or programmed to, based on the drop amount that is the difference between the target number of revolutions of the prime mover and the actual number of revolutions of the prime mover, compute the first reduction amount that is an amount of reduction in number of revolutions of the prime mover in the shift shock reduction control, the second processor is configured or programmed to, based on the degree of straight traveling of the machine body, compute the second reduction amount that is an amount of reduction in the number of revolutions of the prime mover in the shift shock reduction control, and the reduction controller is configured or programmed to perform the shift shock reduction control of reducing the amount of hydraulic fluid supply from the traveling pump to the traveling motor by reducing the number of revolutions of the prime mover based on the first reduction amount computed by the first processor or the second reduction amount computed by the second processor, whichever is larger in absolute value.

3. The working machine according to claim 2, wherein the reduction controller is configured or programmed to set, as a reduced value of the number of revolutions of the prime mover in the shift shock reduction control, a value obtained by subtracting the reduction amount from the actual number of revolutions of the prime mover.

4. The working machine according to claim 3, wherein in a reduction interval till the actual number of revolutions of the prime mover reaching the reduced value, the reduction controller is configured or programmed to set a first rate of reduction in the actual number of revolutions of the prime mover to be constant from a starting point of the reduction interval to an ending point of the reduction interval.

5. The working machine according to claim 3, wherein in a reduction interval till the actual number of revolutions of the prime mover reaching the reduced value, the reduction controller is configured or programmed to set a second rate of reduction in the actual number of revolutions of the prime mover in an interval from a starting point of the reduction interval to some midpoint therein to be higher than a third rate of reduction in the actual number of revolutions of the prime mover in an interval from said some midpoint to an ending point of the reduction interval.

6. The working machine according to claim 3, wherein the reduction controller is configured or programmed to vary timing of switching the traveling switching valve from the second state to the first state according to the drop amount.

7. The working machine according to claim 3, further comprising:

a selector switch configured to issue a shift command for either shift-up switching or shift-down switching; and an accelerator configured to set the target number of revolutions of the prime mover, wherein when the selector switch issues the shift command for the shift-down switching, the reduction controller is configured or programmed to reduce the actual number of revolutions of the prime mover toward a reduced value set based on the reduction amount, and switch the traveling switching valve to either the first state or the second state in accordance with the shift command.

8. The working machine according to claim 3, wherein the reduction controller is configured or programmed to set the reduction amount to be larger as the drop amount is smaller and set the reduction amount to be smaller as the drop amount is larger.

9. The working machine according to claim 2, wherein the reduction controller is configured or programmed to vary timing of switching the traveling switching valve from the second state to the first state according to the drop amount.

10. The working machine according to claim 2, further comprising:

a selector switch configured to issue a shift command for either shift-up switching or shift-down switching; and an accelerator configured to set the target number of revolutions of the prime mover, wherein when the selector switch issues the shift command for the shift-down switching, the reduction controller is configured or programmed to reduce the actual number of revolutions of the prime mover toward a reduced value set based on the reduction amount, and switch the traveling switching valve to either the first state or the second state in accordance with the shift command.

11. The working machine according to claim 2, wherein the reduction controller is configured or programmed to set the reduction amount to be larger as the drop amount is smaller and set the reduction amount to be smaller as the drop amount is larger.

12. The working machine according to claim 1, further comprising:

an actuation valve connected to the operation valve upstream of or downstream of the operation valve and configured to control hydraulic fluid pressure acting from the operation valve on the traveling pump; wherein the controller is configured or programmed to perform the shift shock reduction control of reducing the amount of hydraulic fluid supply from the traveling pump to the traveling motor by reducing the opening of the actuation valve by outputting a control signal to the actuation valve when the shift-down switching is performed, the first processor is configured or programmed to, based on a drop amount that is a difference between a target number of revolutions of the prime mover and an actual number of revolutions of the prime mover, compute a first reduction amount that is an amount of reduction in opening of the actuation valve in the shift shock reduction control, the second processor is configured or programmed to, based on the degree of straight traveling of the machine body, compute a second reduction amount that is an amount of reduction in opening of the actuation valve in the shift shock reduction control, and the reduction controller is configured or programmed to perform the shift shock reduction control of reducing the amount of hydraulic fluid supply from the traveling pump to the traveling motor by reducing the opening of the actuation valve based on a reduction amount that is either the first reduction amount computed by the first processor or the second reduction amount computed by the second processor, whichever is larger in absolute value.

13. The working machine according to claim 12, wherein the actuation valve is a valve whose opening increases as a control value corresponding to the control signal increases and whose opening decreases as the control value decreases, and the controller is configured or programmed to, based on the degree of straight traveling of the machine body, set a reduction amount of the control value as the amount of reduction in opening of the actuation valve, and compute a reduced value in the shift shock reduction control based on the reduction amount.

14. The working machine according to claim 13, wherein in a reduction interval till the control value reaching the reduced value, the controller is configured or programmed to set a first rate of reduction in the control value to be constant from a starting point of the reduction interval to an ending point of the reduction interval.

15. The working machine according to claim 13, wherein in a reduction interval till the control value reaching the reduced value, the controller is configured or programmed to set a second rate of reduction in the control value in an interval from a starting point of the reduction interval to a midpoint between the starting point and an ending point, to be higher than a third rate of reduction in the control value in an interval from the midpoint to the ending point of the reduction interval.

16. The working machine according to claim 13, wherein the controller is configured or programmed to vary timing of switching the traveling switching valve from the first state to the second state according to the degree of straight traveling.

17. The working machine according to claim 13, wherein the controller is configured or programmed to set the reduction amount to be larger as the degree of straight traveling is higher and set the reduction amount to be smaller as the degree of straight traveling is lower.

18. The working machine according to claim 12, wherein the controller is configured or programmed to vary timing of switching the traveling switching valve from the first state to the second state according to the degree of straight traveling.

19. The working machine according to claim 12, wherein the controller is configured or programmed to set the reduction amount to be larger as the degree of straight traveling is higher and set the reduction amount to be smaller as the degree of straight traveling is lower.

20. The working machine according to claim 1, further comprising:

a first traveling device on a left side of the machine body; and a second traveling device on a right side of the machine body, wherein the traveling motor includes a first traveling motor to transmit power for traveling to the first traveling device and a second traveling motor to transmit power for traveling to the second traveling device, the traveling pump rotates the first traveling motor and the second traveling motor, and the traveling switching valve switches a rotation speed of the first traveling motor and a rotation speed of the second traveling motor between the first state and the second state.

* * * * *